US008250489B2

(12) United States Patent
Lee et al.

(10) Patent No.: US 8,250,489 B2
(45) Date of Patent: Aug. 21, 2012

(54) CONTROL UNIT FOR REFRIGERATOR AND METHOD CONTROLLING THE SAME

(75) Inventors: Ik-Kyu Lee, Gimhae (KR); Sung-Ae Lee, Busan (KR); Ji-Won Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 1071 days.

(21) Appl. No.: 12/097,197

(22) PCT Filed: Dec. 12, 2006

(86) PCT No.: PCT/KR2006/005412

§ 371 (c)(1),
(2), (4) Date: Jun. 12, 2008

(87) PCT Pub. No.: WO2007/069843

PCT Pub. Date: Jun. 21, 2007

(65) Prior Publication Data

US 2008/0295033 A1 Nov. 27, 2008

(30) Foreign Application Priority Data

Dec. 12, 2005 (KR) ..... 10-2005-0122046
Dec. 12, 2005 (KR) ..... 10-2005-0122047
Jan. 3, 2006 (KR) ..... 10-2006-0000671
Jul. 6, 2006 (KR) ..... 10-2006-0063614

(51) Int. Cl.
*G06F 3/048* (2006.01)
*G06F 3/00* (2006.01)

(52) U.S. Cl. ..... 715/840; 715/747

(58) Field of Classification Search ..... 715/840, 715/747

See application file for complete search history.

(56) References Cited

U.S. PATENT DOCUMENTS 5,606,374 A 2/1997 Bertram
5,831,852 A * 11/1998 Cahill-O'Brien et al. ..... 700/83
6,393,848 B2 * 5/2002 Roh et al. ..... 62/126

(Continued)

FOREIGN PATENT DOCUMENTS

CN 1955624 A 5/2007
JP 8-331414 A 12/1996
JP 11-295811 A 10/1999
JP 2003-222460 A 8/2003

(Continued)

*Primary Examiner* — William Bashore
*Assistant Examiner* — David Phantana Angkool
(74) *Attorney, Agent, or Firm* — Birch, Stewart, Kolasch & Birch, LLP

(57) ABSTRACT

The present invention relates to a control unit for a refrigerator and a method of controlling the same. A control unit for a refrigerator according to the present invention comprises an input means for receiving an operation signal for setting a service mode of a dispenser provided at the refrigerator; a storage means for storing a plurality of mode image data corresponding to the service mode of the dispenser; a display means for displaying mode images of the mode image data; and a control means for performing control such that mode image data corresponding to the service mode of the dispenser are read from the storage means according to an operation signal received by the input means and a mode image corresponding to the service mode of the dispenser is displayed on the display means. According to the present invention, there are advantages in that more various menus can be displayed in different manners, and the configuration of the input unit is simplified and thus can be more conveniently used.

10 Claims, 18 Drawing Sheets

U.S. PATENT DOCUMENTS

| | | | | |
|---|---|---|---|---|
| 6,934,862 | B2 * | 8/2005 | Sharood et al. | 713/300 |
| 7,092,794 | B1 * | 8/2006 | Hill et al. | 700/276 |
| 2002/0109719 | A1 * | 8/2002 | Hata et al. | 345/748 |
| 2004/0133314 | A1 * | 7/2004 | Ehlers et al. | 700/276 |
| 2005/0090915 | A1 * | 4/2005 | Geiwitz | 700/90 |
| 2005/0109047 | A1 | 5/2005 | Park et al. | |
| 2006/0146773 | A1 * | 7/2006 | An et al. | 370/338 |
| 2006/0152121 | A1 * | 7/2006 | Son et al. | 312/405 |
| 2008/0048046 | A1 * | 2/2008 | Wagner et al. | 236/91 R |

FOREIGN PATENT DOCUMENTS

| | | | |
|---|---|---|---|
| JP | 2005-156143 | A | 6/2005 |
| KR | 10-0182585 | B1 | 5/1999 |
| KR | 10-0377742 | B1 | 3/2003 |

* cited by examiner

【Figure 1】
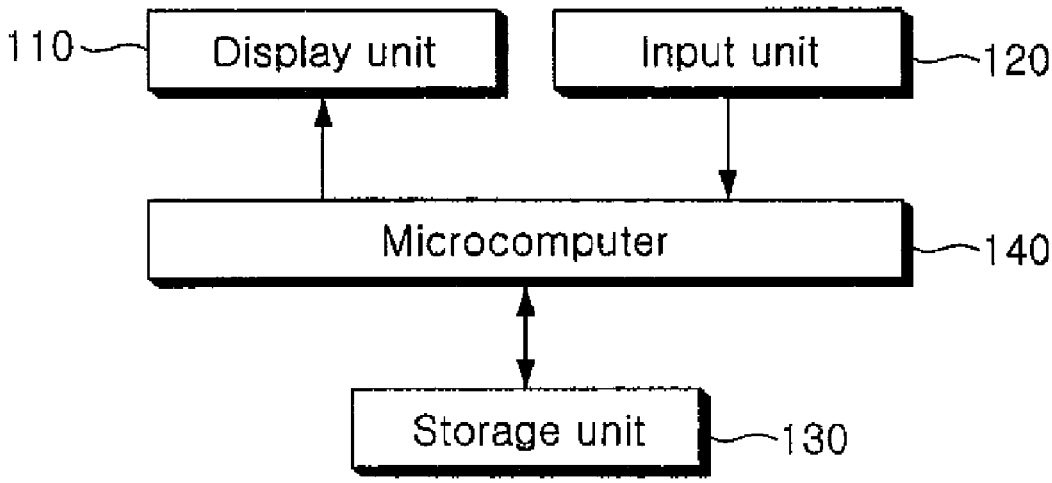

【Figure 2】
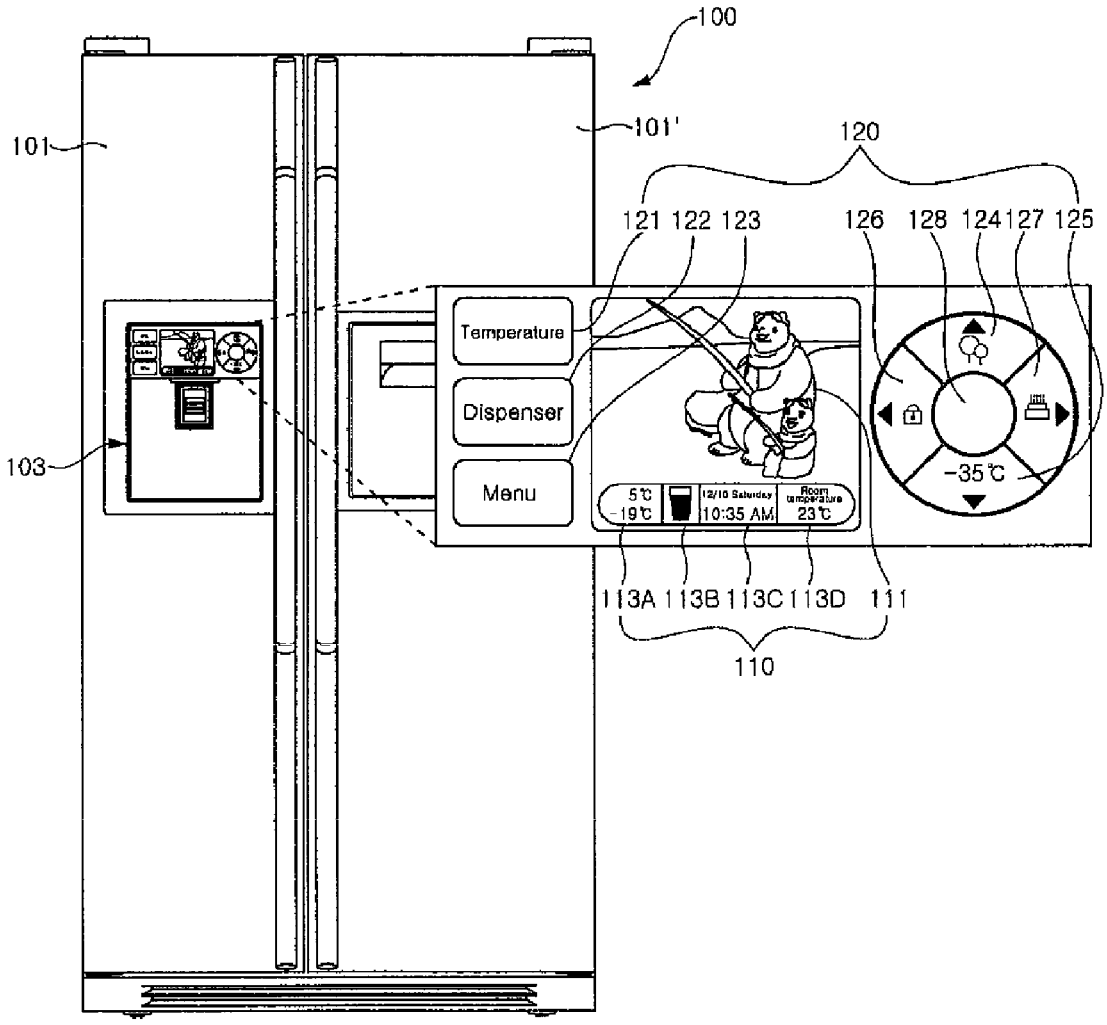

【Figure 3】
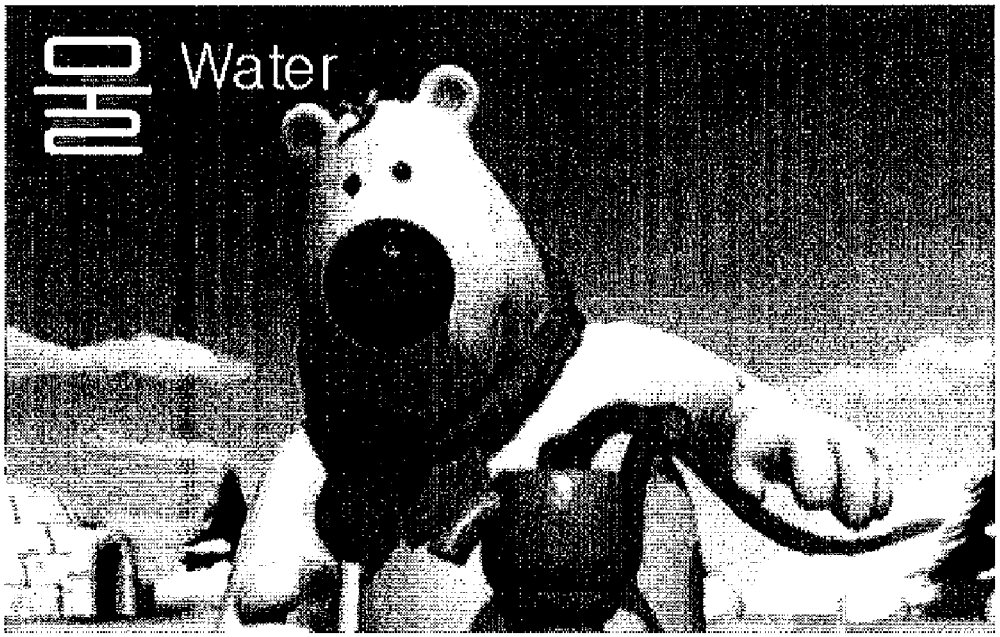
【Figure 4】
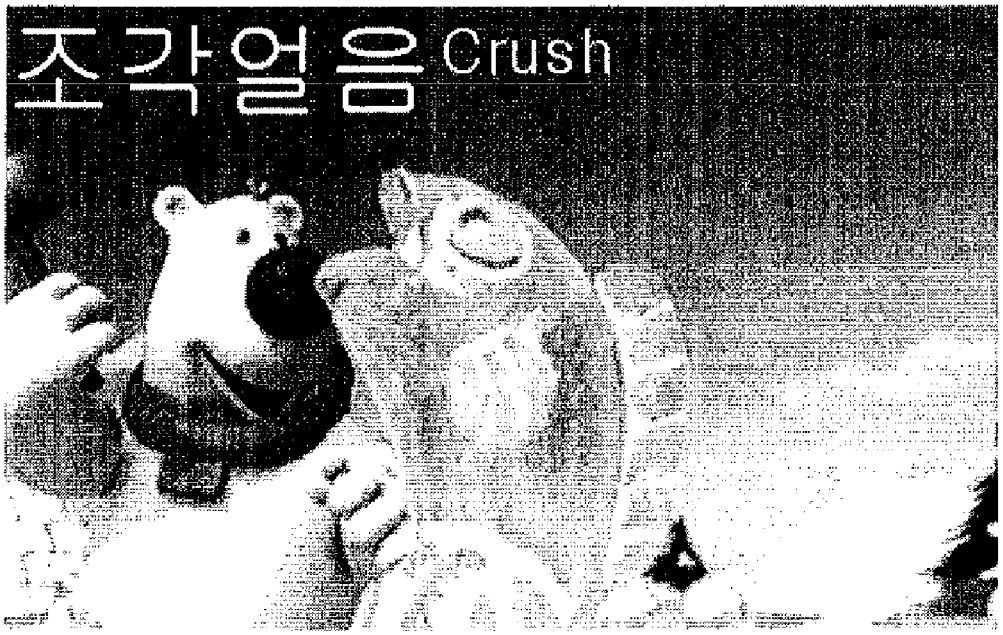

【Figure 5】
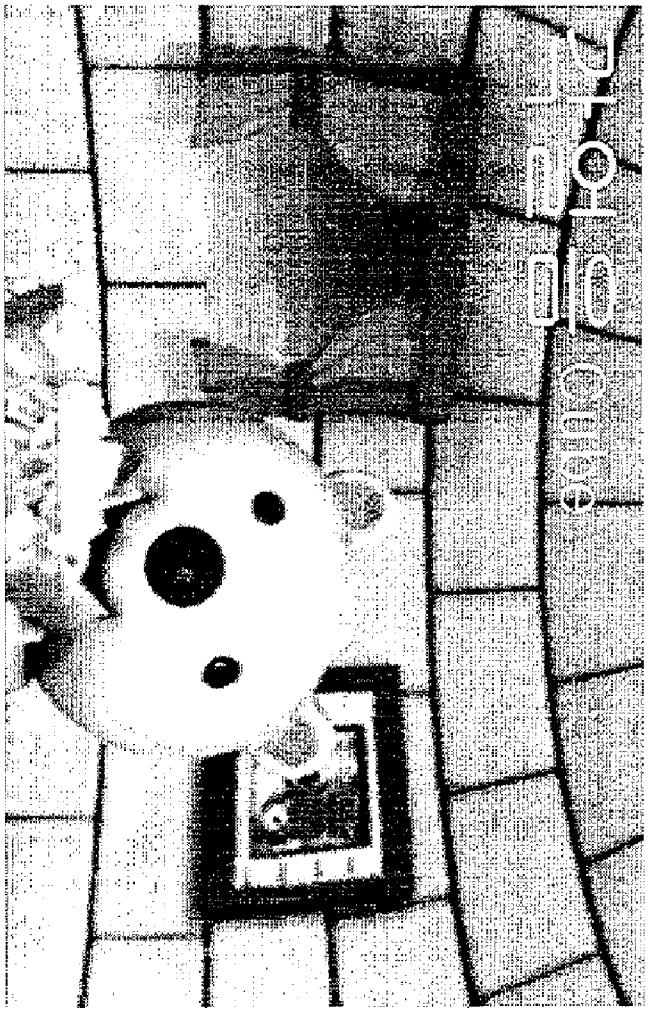

【Figure 6】
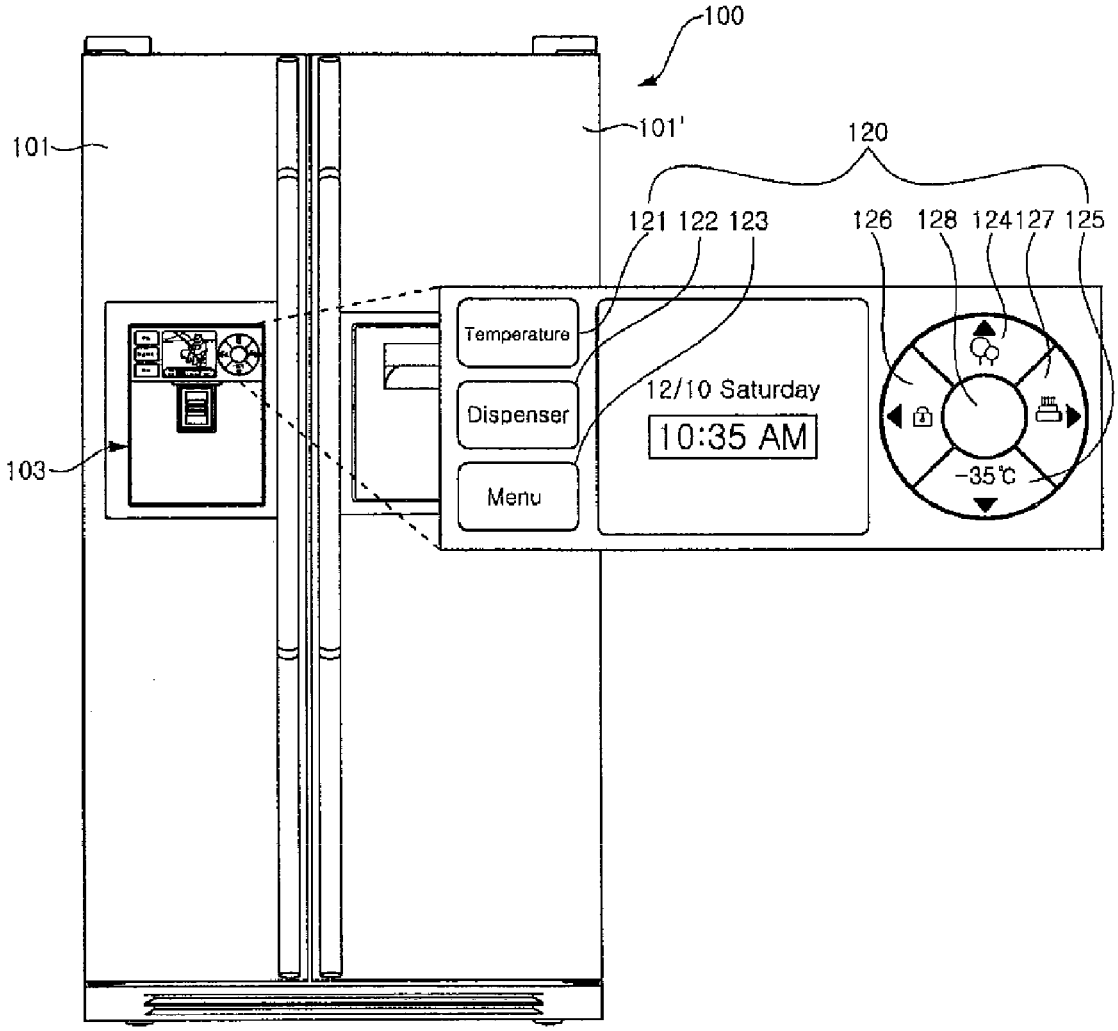

【Figure 7】
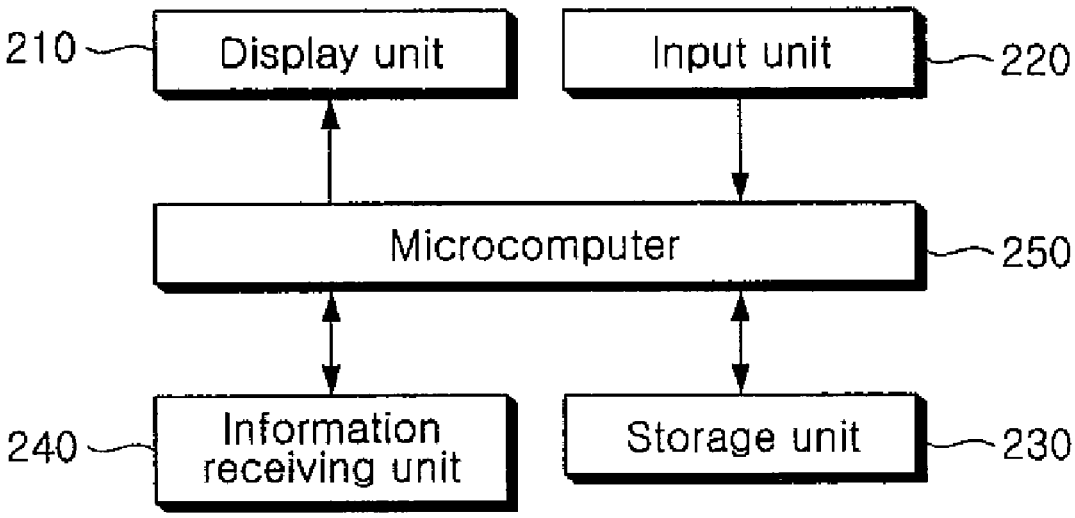

【Figure 8】
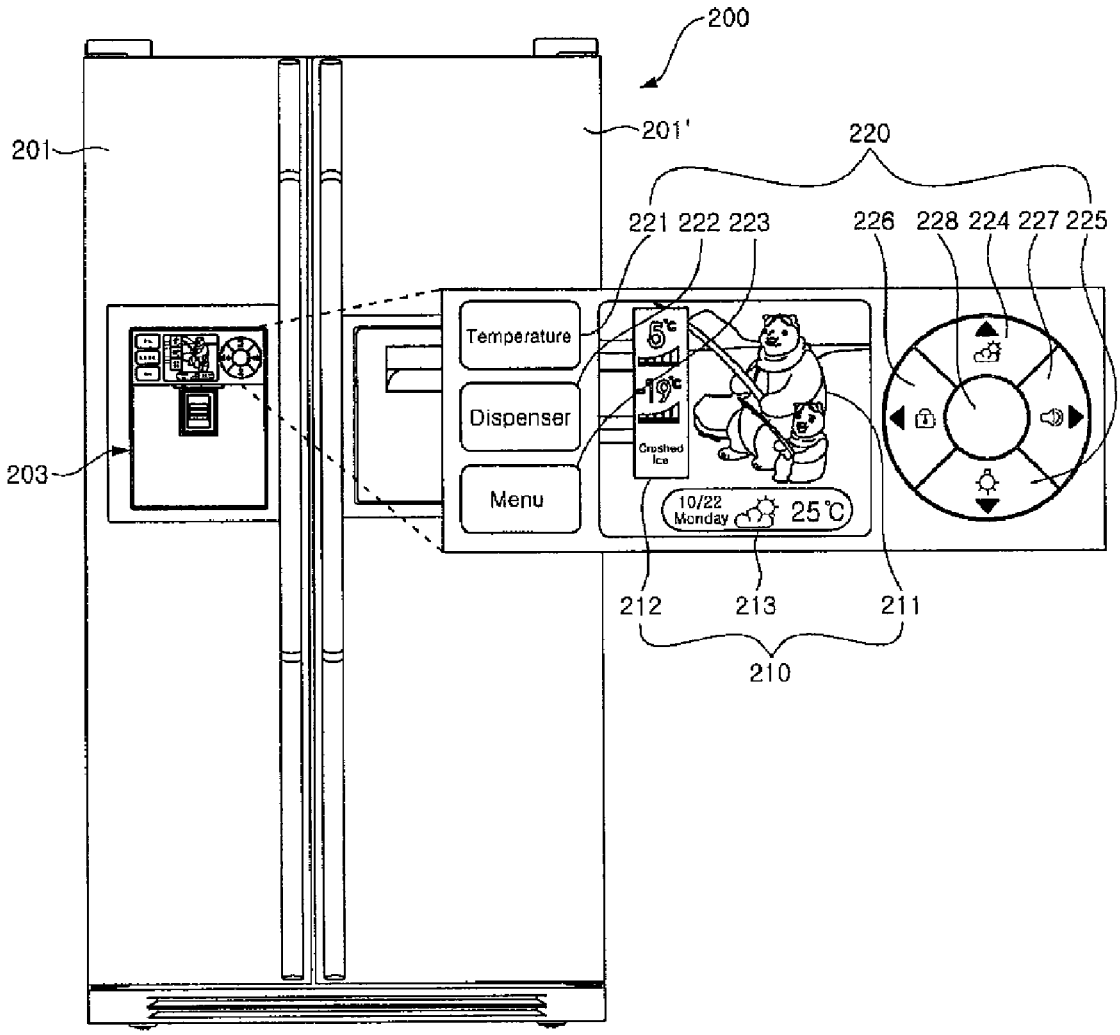

【Figure 9】
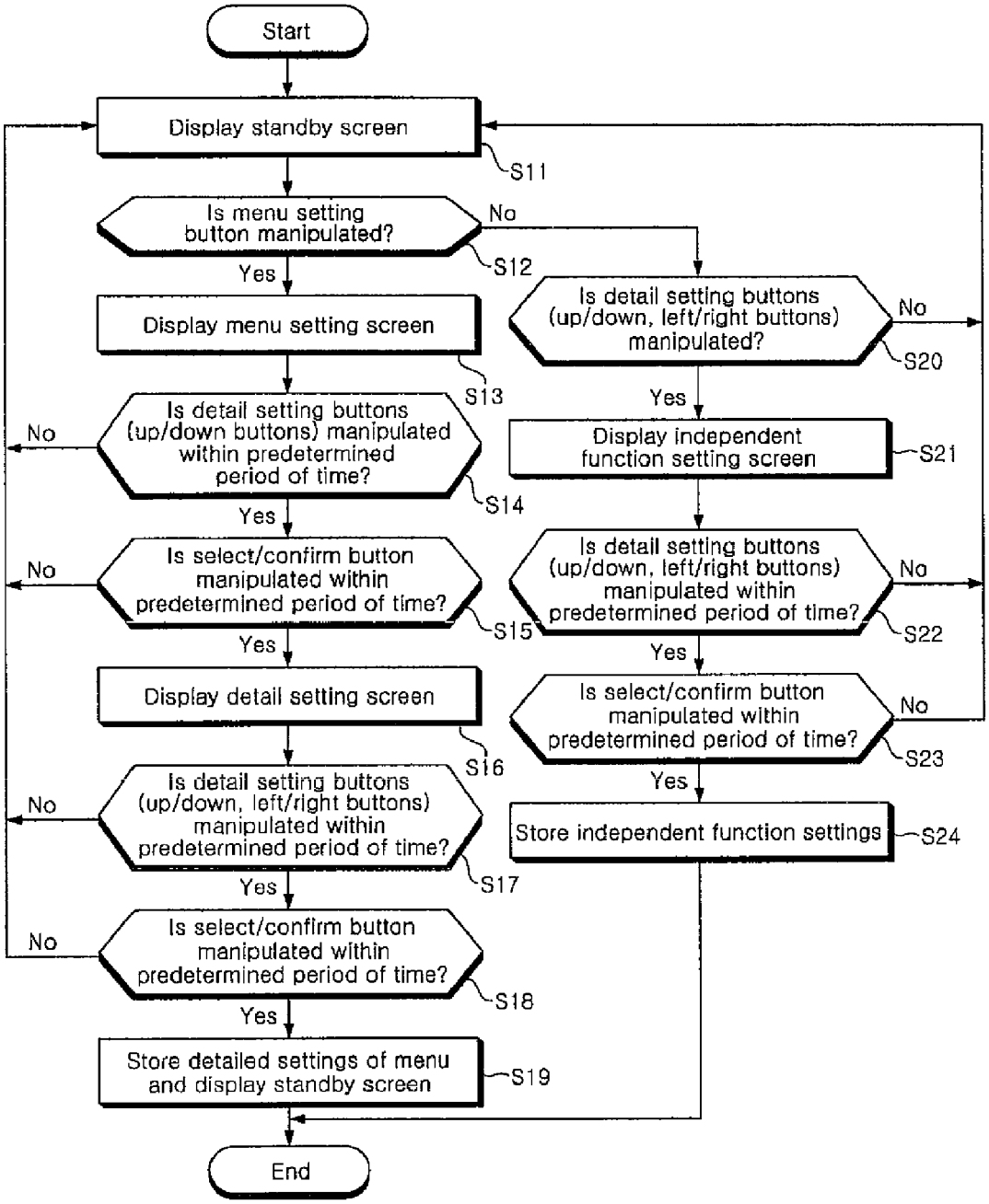

【Figure 10】
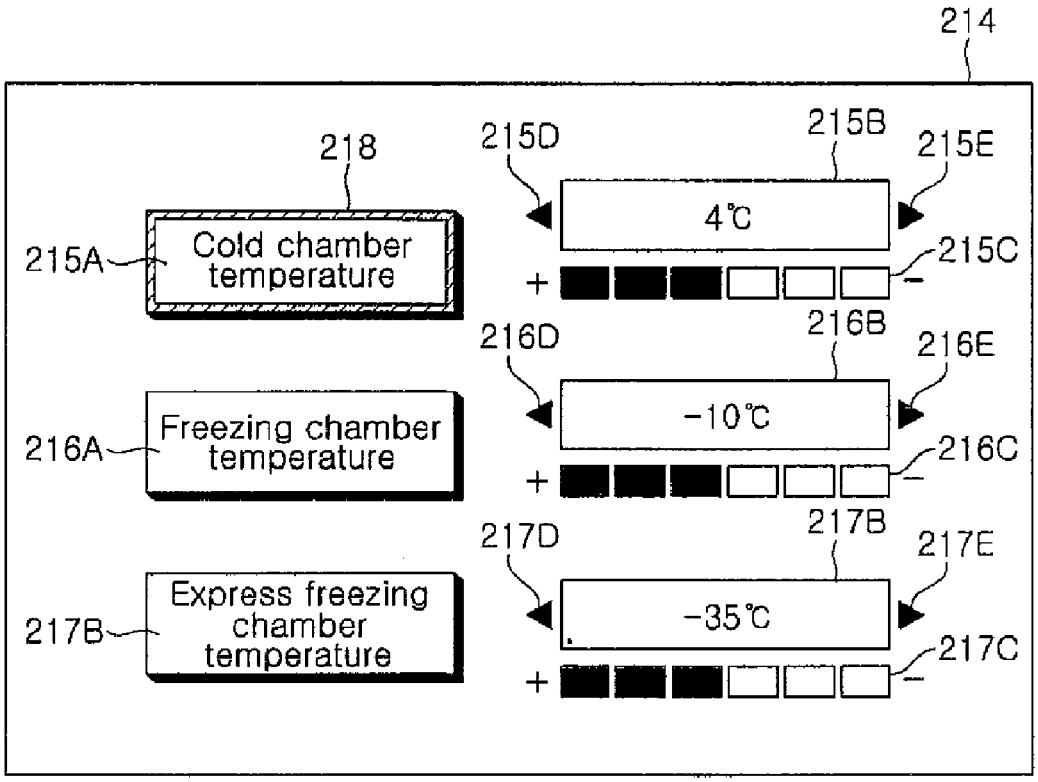
【Figure 11】
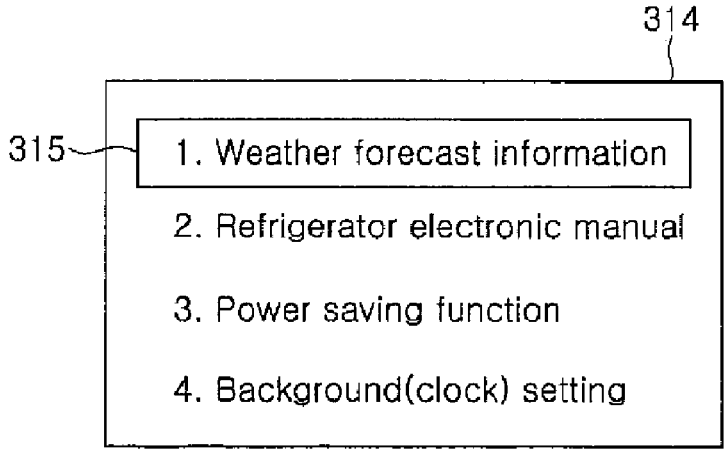

【Figure 12】
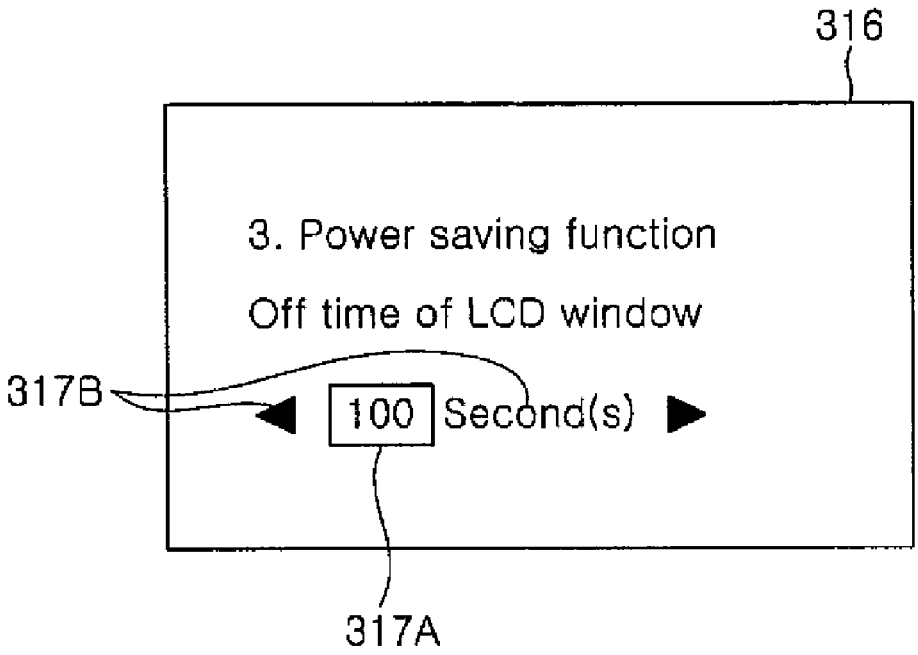
【Figure 13】
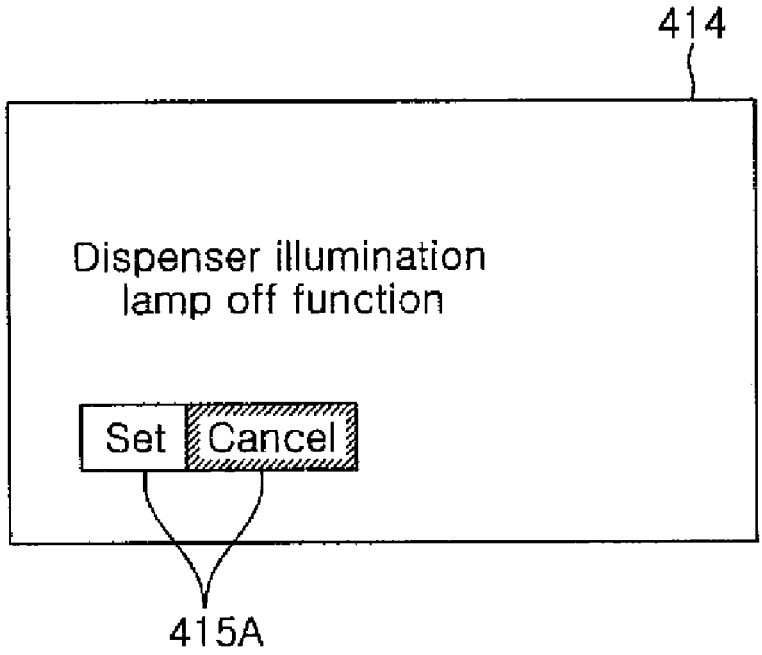

【Figure 14】
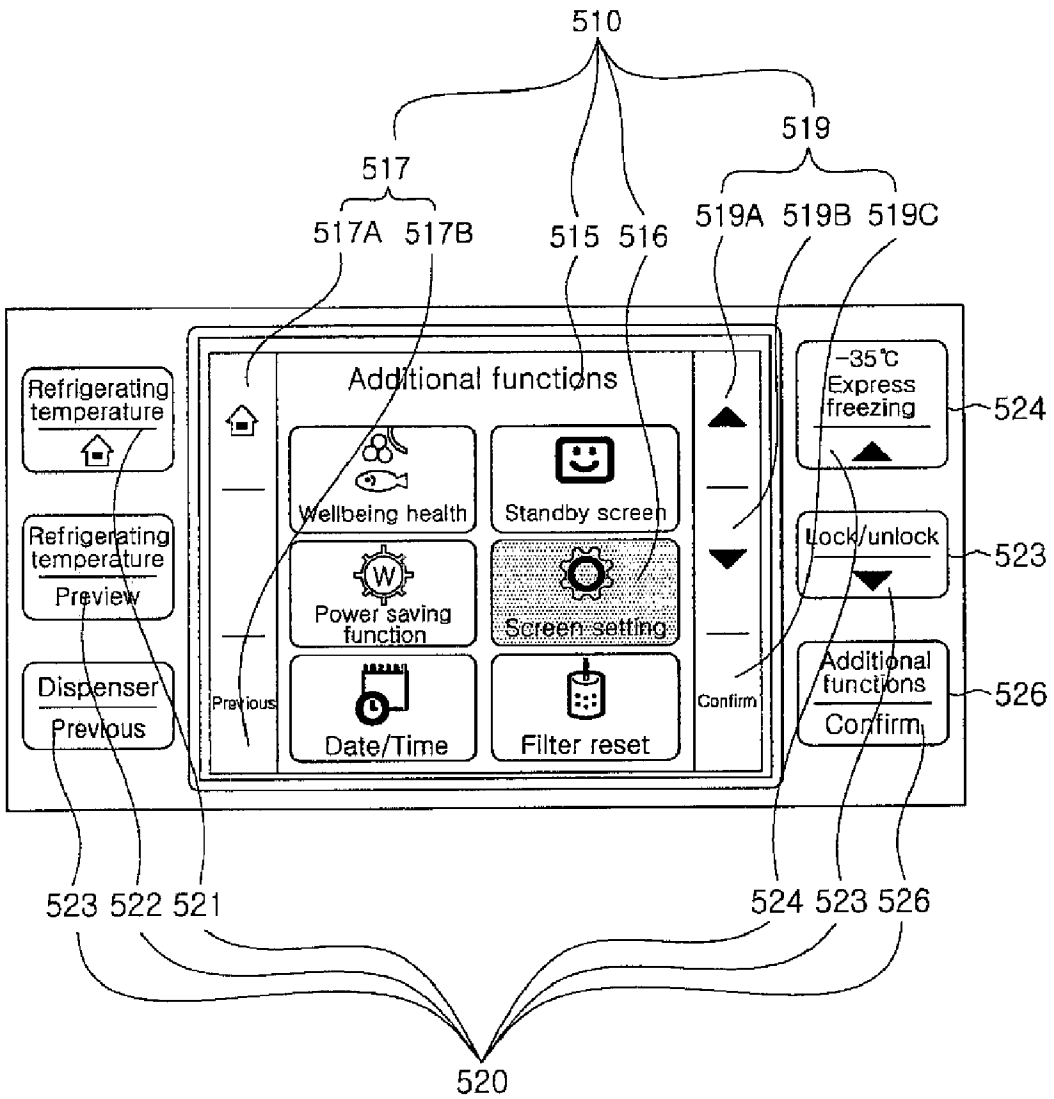

【Figure 15】
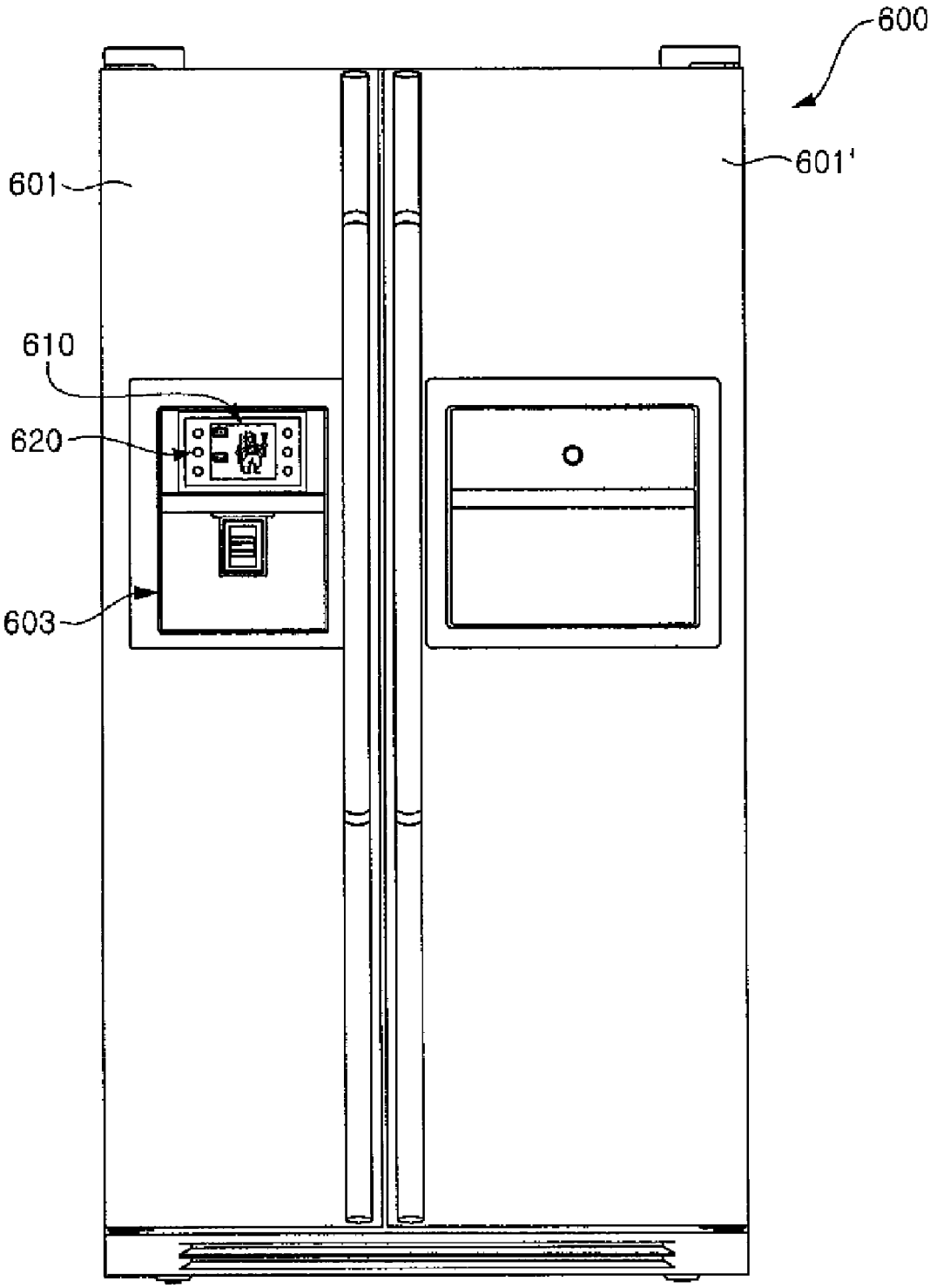

【Figure 16】
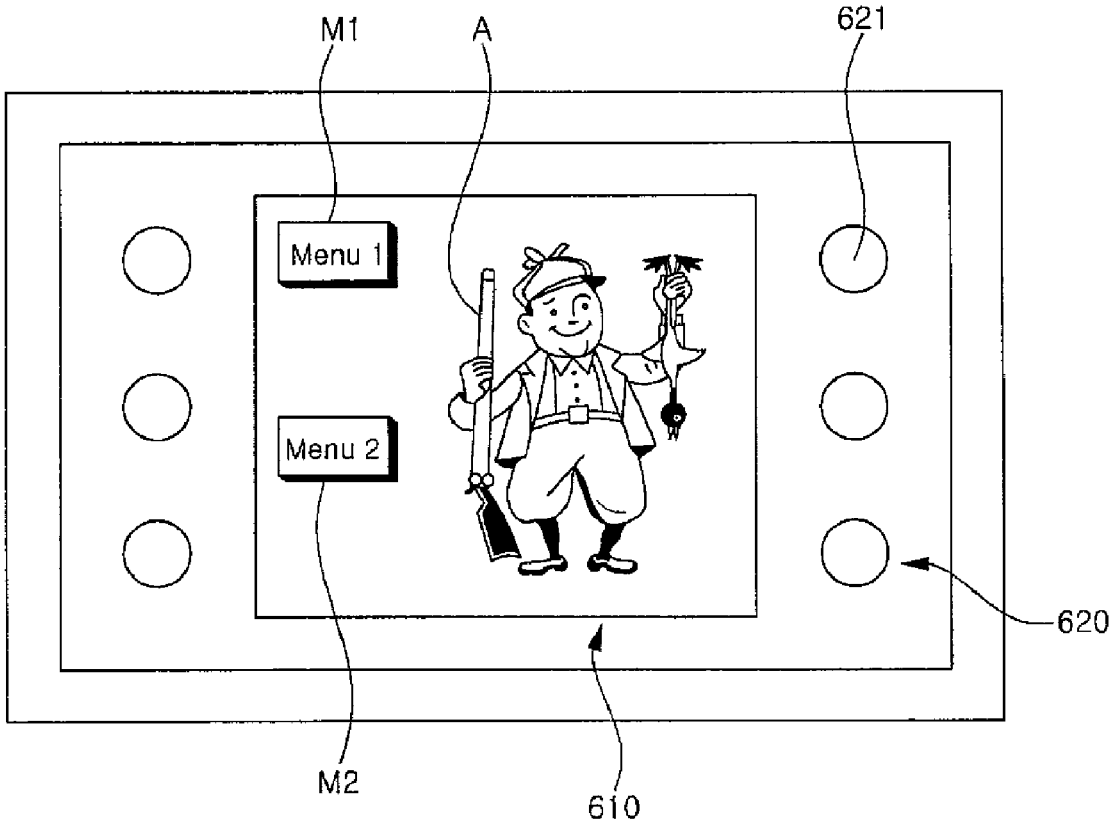

【Figure 17】
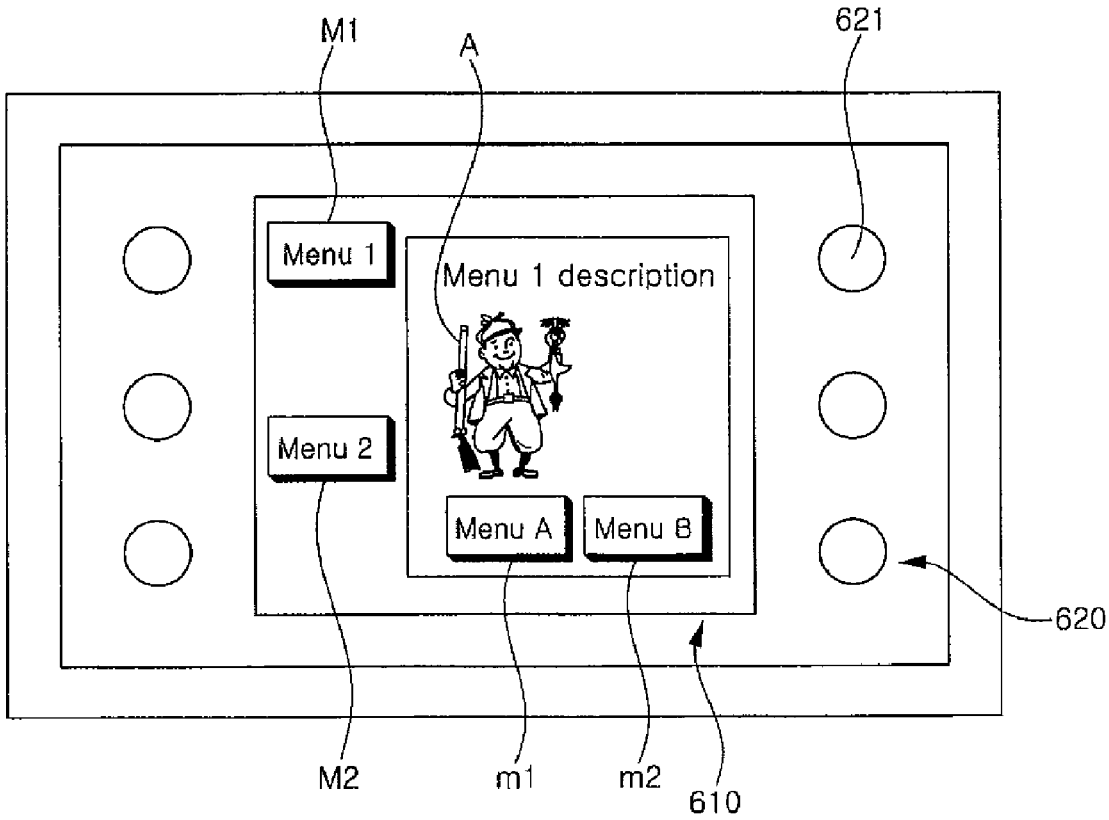

【Figure 18】
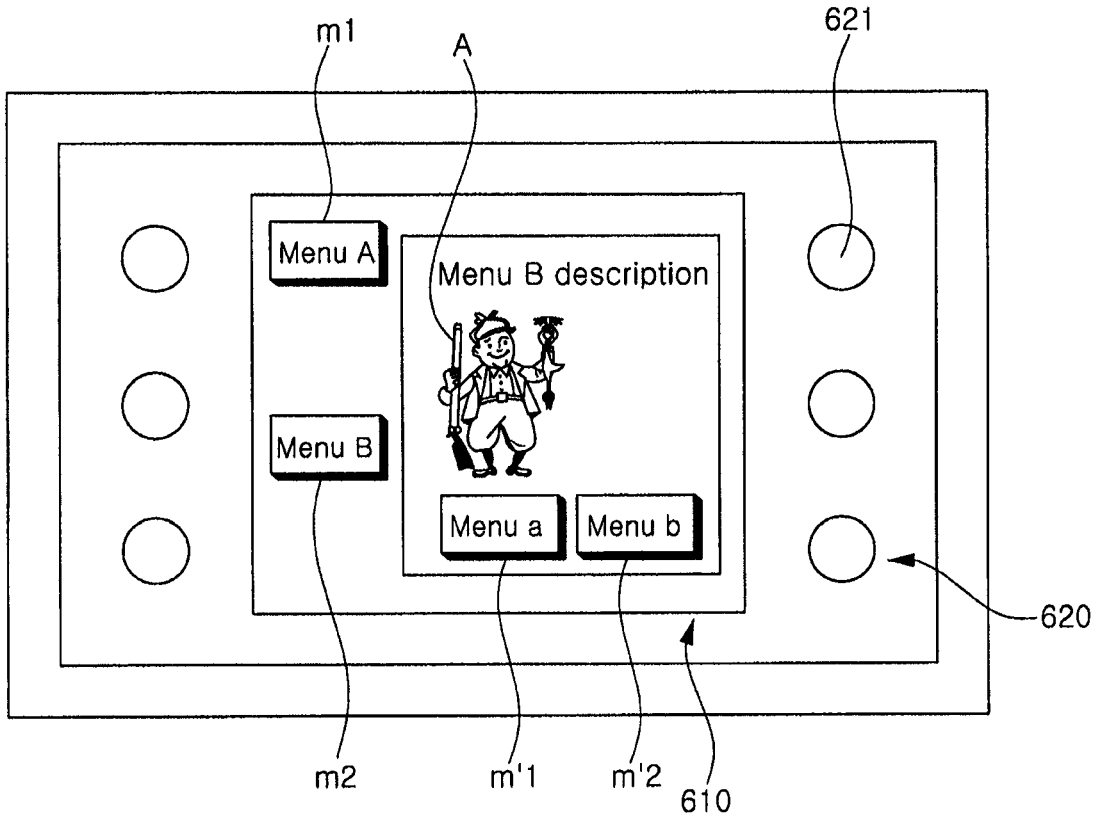

【Figure 19】
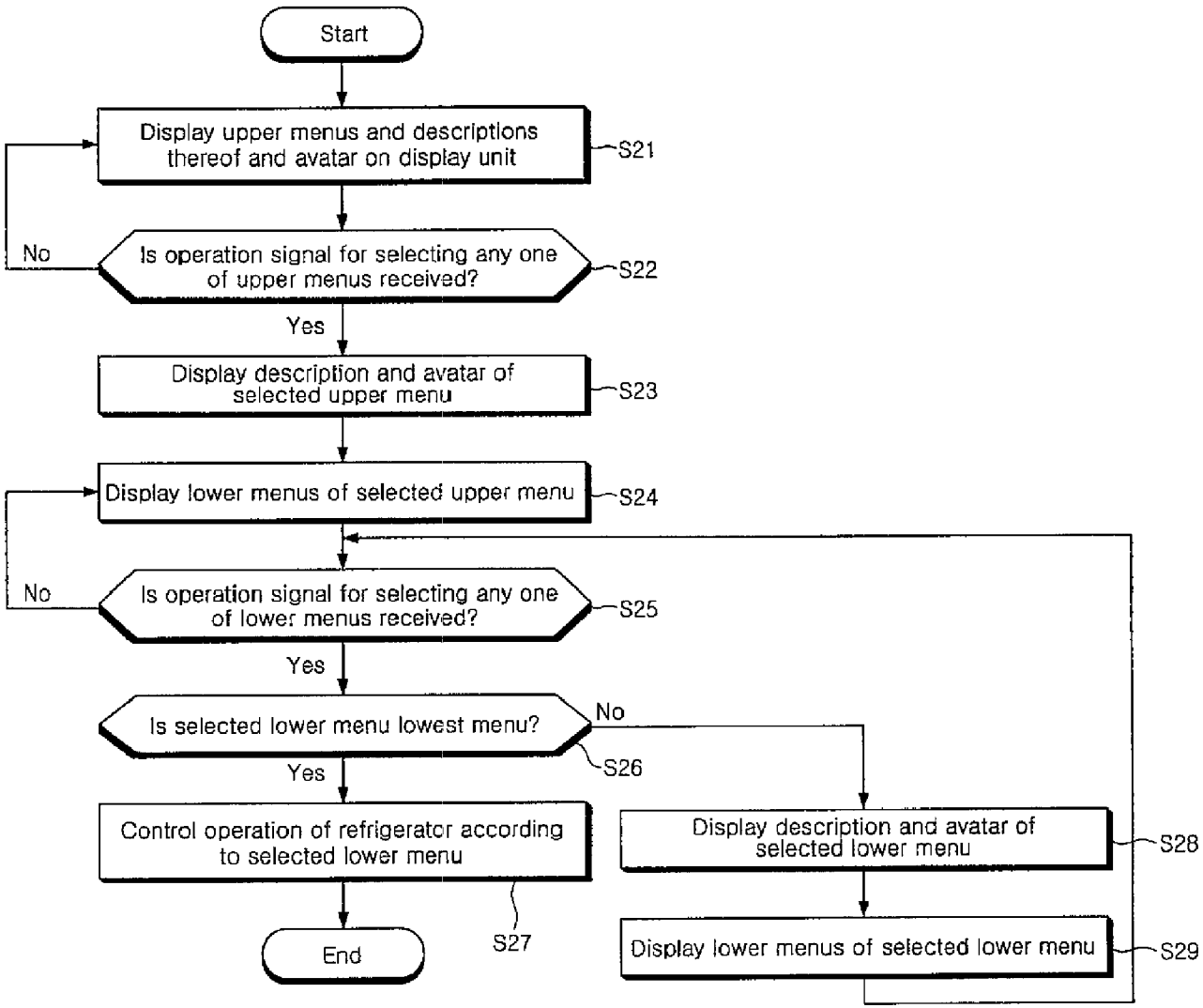

【Figure 20】
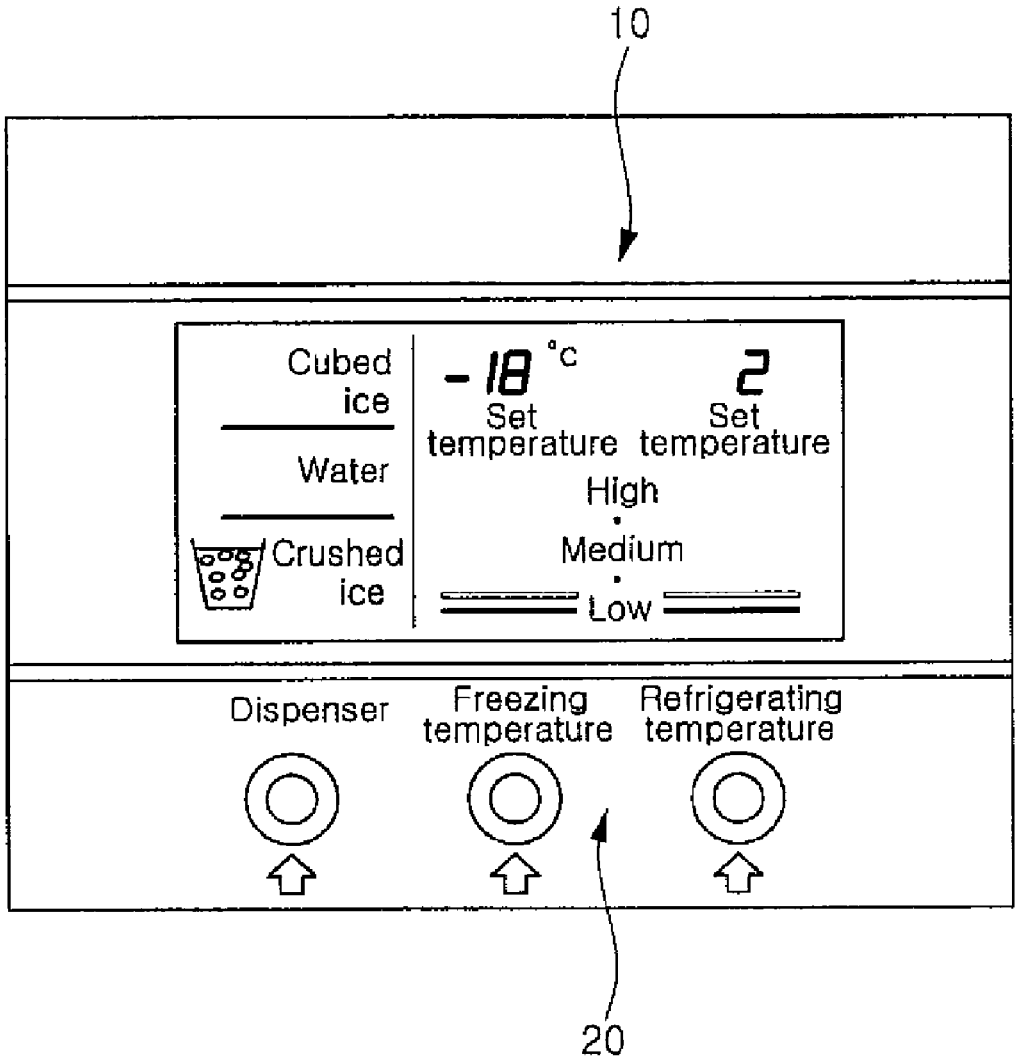

【Figure 21】
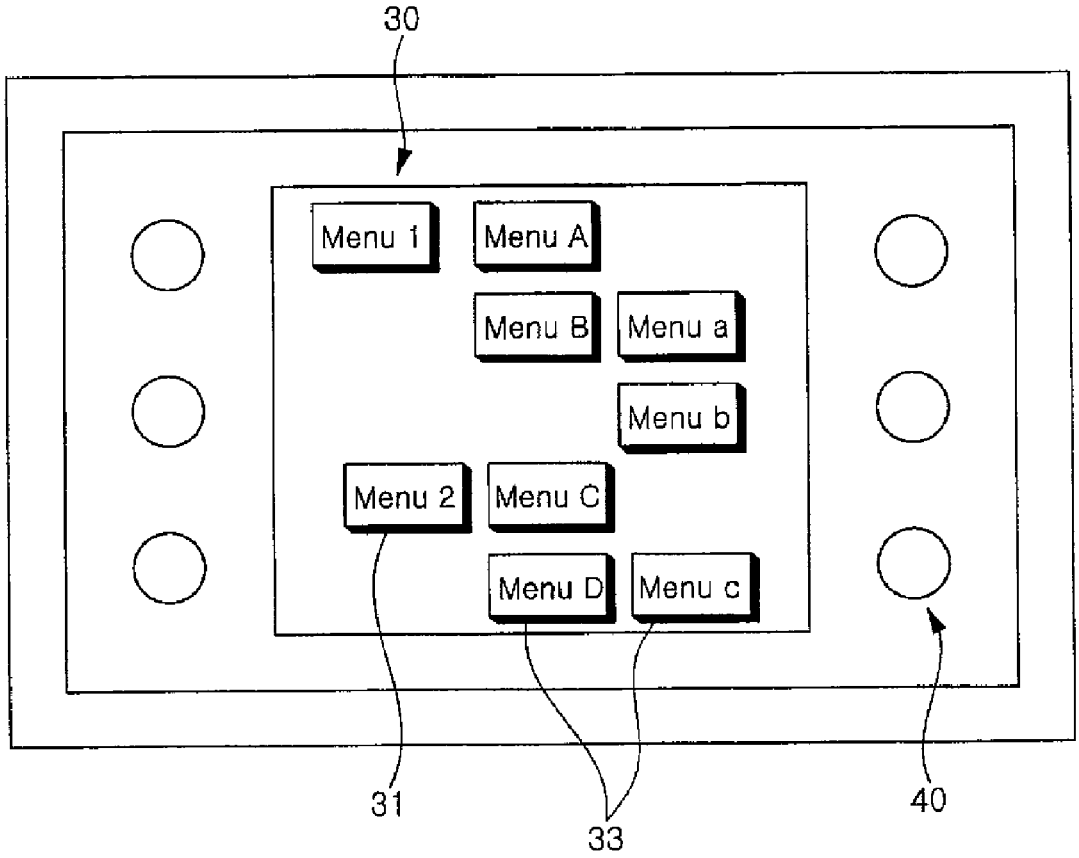

CONTROL UNIT FOR REFRIGERATOR AND METHOD CONTROLLING THE SAME

TECHNICAL FIELD

The present invention relates to a refrigerator, and more particularly, to a control unit for a refrigerator, which receives a variety of operation signals for controlling operations of the refrigerator and causes a variety of information related thereto to be externally displayed, and a method of controlling the control unit.

BACKGROUND ART

Generally, a control unit for a refrigerator comprises an input unit for receiving a variety of operation signals for operations of the refrigerator, a display unit for externally displaying a variety of information on the operations of the refrigerator, and a controller for controlling the input unit and the display unit. FIGS. 20 and 21 are front views schematically showing conventional control unites for refrigerators.

As shown in FIG. 20, a display unit 10 displays a variety of information on operations of a refrigerator, such as set temperatures of a freezing chamber and a refrigerating chamber, and a service mode of a dispenser. An input unit 20 is provided with a plurality of buttons for receiving operation signals for changing the set temperatures of the freezing chamber and the refrigerating chamber or a set value of the service mode of the dispenser.

In addition, as shown in FIG. 21, a display unit 30 displays a variety of menus for operations of a refrigerator. The menus include upper menus 31 and lower menus 33 subordinated thereto. An input unit 40 is provided with a plurality of buttons for receiving operation signals for selecting any one of the upper menus 31 and the lower menus 33 or changing the set value of any selected one of the upper menus 31 and the lower menus 33.

However, the conventional control unites for refrigerators have the following problems.

As described above, the display unit 10 simply displays information on the operations of a refrigerator or menus related to the operations of the refrigerator. Accordingly, there are disadvantages in that menus of a variety of functions according to user's requests cannot be displayed and the menus cannot be displayed in different manners.

Furthermore, each button provided on the input unit 20 or 40 is configured to receive only one operation signal, e.g., one of the buttons is configured to receive only an operation signal for selecting any one of the menus, whereas another button is configured to receive only an operation signal for increasing (or decreasing) the set value of the menu. Accordingly, as many buttons as the numbers of menus and manipulations of the menus should be provided in the input unit 20 or 40, and thus, the input unit 20 or 40 becomes complicated.

In addition, the display unit 30 simultaneously displays the upper menus 31 and the lower menus 33 subordinated thereto. Accordingly, since menus are complicatedly displayed on the display unit 30, a user suffers from inconvenience in using the menus since the upper menus 31 and the lower menus 33 displayed on the display unit 30 cannot be easily identified.

DISCLOSURE OF INVENTION

Technical Problem

The present invention is conceived to solve the aforementioned problems. Accordingly, an object of the present invention is to provide a control unit for a refrigerator in which menus of more various functions can be displayed in different manners, and a method of controlling the control unit.

Another object of the present invention is to provide a control unit for a refrigerator in which an input unit is more simplified, and a method of controlling the control unit.

A further object of the present invention is to provide a control unit for a refrigerator, which is constructed to be more conveniently used, and a method of controlling the control unit.

Technical Solution

According to an aspect of the present invention for achieving the object, there is provided a control unit for a refrigerator, comprising: an input means for receiving an operation signal for setting a service mode of a dispenser provided at the refrigerator; a storage means for storing a plurality of mode image data corresponding to the service mode of the dispenser; a display means for displaying mode images of the mode image data; and a control means for performing control such that mode image data corresponding to the service mode of the dispenser are read from the storage means according to an operation signal received by the input means and a mode image corresponding to the service mode of the dispenser is displayed on the display means.

It is prefer the input means comprises at least a first manipulation button for receiving an operation signal for changing setting of the service mode of the dispenser, and a second manipulation button for receiving an operation signal for storing the setting of the service mode of the dispenser, and the control means performs control such that a mode image of the service mode of the dispenser is displayed on the display means if the first manipulation button receives an operation signal, the mode image of the service mode of the dispenser is sequentially changed and displayed on the display means if the first manipulation button receives an operation signal in a state where the mode image of the service mode of the dispenser is displayed on the display means, and the service mode of the dispenser is set to a service mode corresponding to a mode image of the service mode of the dispenser displayed on the display means if the second manipulation button receives an operation signal in a state where the mode image of the service mode of the dispenser is displayed on the display means.

The control means performs control such that the mode image of the service mode of the dispenser is displayed on the display means if the input means receives an operation signal, the mode image of the service mode of the dispenser is sequentially changed and displayed on the display means if the input means receives an operation signal within a predetermined period of time in a state where the mode image of the service mode of the dispenser is displayed on the display means, and the service mode of the dispenser is set to a service mode corresponding to the mode image of the service mode of the dispenser displayed on the display means if a predetermined period of time is elapsed in a state where the mode image of the service mode of the dispenser is displayed on the display means.

A plurality of background screen data to be displayed on the display means may be further stored in the storage means, and the control means performs control such that a background screen image of the background screen data is displayed on the display means only until the input means may receive an operation signal.

The mode image may include at least one of a still image, a moving image, an animation, and a letter.

The mode image may further includes an avatar of a certain image.

Information data including at least information on a set service mode of the dispenser may be further stored in the storage means, and the control means may perform control such that the service mode information of the dispenser stored in the storage means is updated with a service mode of the dispenser that is set according to an operation signal received by the input means.

The control means may perform control such that the updated service mode information of the dispenser is displayed as an information screen on the display means.

According to another aspect of the present invention, there is provided a control unit for a refrigerator, comprising an input means for receiving an operation signal for setting a service mode of a dispenser provided at the refrigerator; a storage means for storing background screen data and information data including at least information on a set service mode of the dispenser; a display means for displaying a background screen image of the background screen data and an information image of the information data; and a control means for performing control such that information data corresponding to the information on the service mode of the dispenser are read from the storage means according to an operation signal received by the input means and an information image corresponding to the service mode of the dispenser is displayed on the display means.

The input means may comprise at least a first manipulation button for receiving an operation signal for changing setting of the service mode of the dispenser, and a second manipulation button for receiving an operation signal for storing the setting of the service mode of the dispenser, and the control means performs control such that an information image of the service mode of the dispenser is displayed on the display means if the first manipulation button receives an operation signal, the information image of the service mode of the dispenser is sequentially changed and displayed on the display means if the first manipulation button receives an operation signal in a state where the information image of the service mode of the dispenser is displayed on the display means, and the service mode of the dispenser is set to a service mode corresponding to an information image of the service mode of the dispenser displayed on the display means if the second manipulation button receives an operation signal in a state where the information image of the service mode of the dispenser is displayed on the display means.

The control means may perform control such that the information image of the service mode of the dispenser is displayed on the display means if the input means receives an operation signal, the information image of the service mode of the dispenser is sequentially changed and displayed on the display means if the input means receives an operation signal within a predetermined period of time in a state where the information image of the service mode of the dispenser is displayed on the display means, and the service mode of the dispenser is set to a service mode corresponding to the information image of the service mode of the dispenser displayed on the display means if a predetermined period of time is elapsed in a state where the information image of the service mode of the dispenser is displayed on the display means.

The control means may perform control such that the background screen image and the information image are displayed on the display means in such a manner that the entire information image overlaps with a portion of the background screen image.

Standby screen data to be displayed on the display means may be further stored in the storage means, and the control means performs control such that a standby screen image of the standby screen data is displayed on the display means in other cases except a case where the refrigerator is manipulated by a user.

If the refrigerator is manipulated by the user in a state where the standby screen image is displayed on the display means, the control means may perform control such that a reduced standby screen image is displayed at one side of the background screen image in a state where the background screen image is displayed on the display means.

The standby screen image may be an information image of at least one piece of information among information data stored in the storage means.

According to a further aspect of the present invention, there is provided a control unit for a refrigerator, comprising: an input means having a temperature setting button for receiving an operation signal for selecting a temperature setting menu for a storage space of the refrigerator, and a detail setting button for receiving an operation signal for setting a temperature of the storage space or setting an independent function; and a control means for performing control such that the setting of the temperature of the storage space or the setting of the independent function is carried out according to a sequence of manipulating the temperature setting button and the detail setting button.

The control means may perform control such that the temperature setting for the storage space is carried out if the temperature setting button is manipulated prior to manipulation of the detail setting button, and the independent function setting is carried out if the detail setting button is manipulated prior to manipulation of the temperature setting button.

According to a still further aspect of the present invention, there is provided a control unit for a refrigerator, comprising: an input means having a temperature setting button for receiving an operation signal for selecting a temperature setting menu for a storage space of the refrigerator, and a detail setting button for receiving an operation signal for setting a temperature of the storage space or setting an independent function; a storage means for storing a temperature setting screen for setting a temperature of the storage space and an independent function setting screen for setting an independent function; a display means for displaying the temperature setting screen and the independent function setting screen; and a control means for performing control such that the temperature setting screen or the independent function setting screen is displayed on the display means according to a sequence of manipulating the temperature setting button and the detail setting button.

The control means may perform control such that the temperature setting screen is displayed on the display means if the temperature setting button is manipulated prior to manipulation of the detail setting button, and the independent function setting screen is displayed on the display means if the detail setting button is manipulated prior to manipulation of the temperature setting button.

The storage space may include at least any one of a refrigerating chamber, a freezing chamber, and an express freezing chamber, and the temperature setting menu may include at least any one of a refrigerating chamber temperature setting menu, a freezing chamber temperature setting menu, and an express freezing chamber temperature setting menu.

The detail button may include: a pair of buttons for sequentially highlighting a menu in order to select any one of the refrigerating chamber temperature setting menu, the freezing chamber temperature setting menu, and the express freezing chamber temperature setting menu displayed on the display means; a pair of buttons for increasing or decreasing any one of a set temperature of the refrigerating chamber, a set temperature of the freezing chamber, and a set temperature of the express freezing chamber displayed on the display means; and a button for selecting any one of the refrigerating chamber temperature setting menu, the freezing chamber temperature setting menu, and the express freezing chamber temperature setting menu, or for confirming an increase or decrease in any one of the refrigerating chamber set temperature, the freezing chamber set temperature, and the express freezing chamber set temperature.

The temperature setting screen and the independent function setting screen may include function display bars for displaying the functions of the temperature setting button and the detail setting button for temperature setting or independent function setting, respectively, and the control means may perform control such that if any one of the temperature setting screen and the independent function setting screen is displayed on the display means, the function display bar for temperature setting or independent function setting is displayed at one side of the display means in the vicinity of the temperature setting button or the detail setting button.

According to a still further aspect of the present invention, there is provided a control unit for a refrigerator, comprising: an input means having a menu setting button for receiving an operation signal for selecting a menu of the refrigerator to be set, and a detail setting button for receiving an operation signal for detail setting of a selected menu or separate independent function setting; and a control means for performing control such that either the menu setting and detail setting thereof or the independent function setting is carried out according to a sequence of manipulating the menu setting button and the detail setting button.

The control means may perform control such that the menu setting and detail setting thereof are carried out if the menu setting button is manipulated prior to manipulation of the detail setting button, and the independent function setting is carried out if the detail setting button is manipulated prior to manipulation of the menu setting button.

According to a still further aspect of the present invention, there is provided a control unit for a refrigerator, comprising: an input means having a menu setting button for receiving an operation signal for menu setting or information display for the refrigerator and a detail setting button for receiving an operation signal for detail setting of a selected menu or separate independent function setting; a storage means for storing a menu setting screen for the menu setting, a detail setting screen for the detail setting of the selected menu, and an independent function setting screen for the independent function setting; a display means for displaying the menu setting screen, the detail setting screen, and the independent function setting screen; and a control means for performing control such that any one of sequential display of the menu setting screen and the detail setting screen, display of information, and display of the independent function setting screen is carried out on the display means according to a sequence of manipulating the menu setting button and the detail setting button.

The control means may perform control such that the sequential display of the menu setting screen and the detail setting screen or the display of information is carried out on the display means if the menu setting button is manipulated prior to manipulation of the detail setting button, and the display of the independent function setting screen is carried out on the display means if the detail setting button is manipulated prior to manipulation of the menu setting button.

The detail setting button may include: a pair of buttons for alternately highlighting the menu and the information in order to select either of the menu or the information displayed on the display means; a pair of buttons for changing a set value for the detail setting of the menu; a button for selecting either of the menu or the information, or confirming a change in the set value for the detail setting of the menu.

The menu setting screen, the detail setting screen, and the independent function setting screen may include function display bars for displaying functions of the menu setting button and detail setting button for the menu setting and detail setting and the independent function setting, respectively, and the control means may perform control such that the function display bar for the menu setting and detail setting or the independent function setting is displayed at one side of the display means in the vicinity of the menu setting button and the detail setting button if any one of the temperature setting screen, the detail setting screen, and the independent function setting screen is displayed on the display means.

According to a still further aspect of the present invention, there is provided a method of controlling a control unit for a refrigerator, the control unit including an input means for receiving an operation signal for selecting a menu for manipulating the refrigerator, and a display means for displaying a menu and a corresponding avatar according to the operation signal inputted through the input means, the method comprising the steps of: (A) displaying, by the display means, one or more menus; (B) receiving, by the input means, an operation signal for selecting any one of the menus displayed on the display means in step (A); and (C) displaying, by the display means, an avatar corresponding to the menu selected according to the operation signal received by the input means in step (B).

In step (C), the display means may further display a description of the selected menu.

In step (C), the display means may further display one or more lower menus subordinate to the selected menu.

In step (C), the display means may further display descriptions of the lower menus.

According to a still further aspect of the present invention, there is Her comprising the steps of: (D) receiving, by the input means, an operation signal for selecting any one of the lower menus displayed on the display means in step (C); and (E) controlling, by control means, an operation of the refrigerator according to a menu selected according to the operation signal received by the input means in step (D).

In step (C), the display means may display an avatar image such that the avatar can be changed according to the selected menu or lower menu.

Advantageous Effects

With the control unit for a refrigerator and a method of controlling the same according to the present invention, there are advantages in that more various menus can be displayed in different manners, and the configuration of the input unit is simplified so that the input unit can be more conveniently used.

DESCRIPTION OF DRAWINGS

FIG. 1 is a view schematically showing the configuration of a control unit for a refrigerator according to a preferred embodiment of the present invention.

FIG. 2 is a front view showing a refrigerator provided with the control unit according to the preferred embodiment of the present invention.

FIGS. 3 to 5 are front views schematically showing mode images corresponding to service modes of a dispenser, which are displayed according to a preferred embodiment of the present invention.

FIG. 6 is a front view schematically showing a standby screen image displayed according to a preferred embodiment of the present invention.

FIG. 7 is a view schematically showing the configuration of a control unit for a refrigerator according to a second embodiment of the present invention.

FIG. 8 is a front view showing a refrigerator provided with the control unit according to the second embodiment of the present invention.

FIG. 9 is a flowchart illustrating menu setting and detail setting processes in the second embodiment of the present invention.

FIG. 10 is a front view schematically showing a temperature setting screen displayed on the display unit in the second embodiment of the present invention.

FIG. 11 is a front view schematically showing a menu setting screen displayed on the display unit in the second embodiment of the present invention.

FIG. 12 is a front view schematically showing a detail setting screen for the menu setting screen shown in FIG. 11.

FIG. 13 is a front view schematically showing an independent function screen displayed on the display unit in the second embodiment of the present invention.

FIG. 14 is a front view schematically showing a control unit for a refrigerator according to a third embodiment of the present invention.

FIG. 15 is a front view showing a refrigerator provided with a control unit for a refrigerator according to a fourth embodiment of the present invention.

FIGS. 16 to 18 are views schematically showing a process of displaying menus on a display unit in the fourth embodiment of the present invention.

FIG. 19 is a flowchart illustrating the process of displaying menus on the display unit in the fourth embodiment of the present invention.

FIGS. 20 and 21 are front views schematically showing a conventional control unit for a refrigerator.

BEST MODE

FIG. 1 is a view schematically showing the configuration of a control unit for a refrigerator according to a preferred embodiment of the present invention, and FIG. 2 is a front view showing a refrigerator provided with the control unit according to the preferred embodiment of the present invention.

As shown in the figures, the control unit for a refrigerator comprises a display unit 110 for displaying user interfaces and screen information, an input unit 120 for receiving commands from a user, a storage unit 130 for storing the user interfaces, screen information data) and mode image data corresponding to service modes of a dispenser 103, and a microcomputer 140 for controlling the display unit 110, the input unit 120 and the storage unit 130.

A main microcomputer (not shown) that controls basic operations of the refrigerator, i.e., freezing or refrigerating operations, may perform the function of the microcomputer 140, or the microcomputer 140 may be separately provided. If the microcomputer 140 is separately provided, it is connected to the main microcomputer through a communication line for data communications.

As shown in FIG. 2, the display unit 110 is provided at a side of a front surface of a door 101 of a pair of doors 101 and 101' that are provided at a main body 100 of the refrigerator. In the embodiment shown in the figure, the display unit 110 is placed above the dispenser 103 that is provided at a side of the front surface of the door 101. However, the position of the display unit 110 is not limited thereto but the display unit may be placed at any place to which the user can easily access.

A color thin film transistor liquid crystal display (TFT LCD) that can display user interfaces and images is preferably used as the display unit 110. A main screen, a standby screen, and the mode images corresponding to the service modes of the dispenser 103 are displayed on the display unit 110.

The main screen displayed on the display unit 110 includes a background screen 111 for displaying a background containing an avatar or the like, and an information screen 113 for displaying basic information. The background screen 111 is displayed on the entire portion of the display unit 110, and the information screen 113 is displayed on a lower portion of or below the background screen 111 in a size relatively smaller than that of the background screen 111. That is, the information screen 113 can be displayed while substantially overlapping with a portion of the background screen 111. If the information screen 113 is displayed while overlapping with the background screen 111, the colors thereof are preferably determined in an extent that the colors are not mixed with each other even though they overlap with each other.

The background screen 111 includes a background image and an avatar displayed on the background image, wherein the shape or motion of the avatar varies according to the operation or state of the refrigerator. Here, the avatar is a character in a cyberspace and means herein a character that is represented in a certain shape and motion.

The basic information displayed on the information screen 113 includes the set temperatures of the freezing chamber and the refrigerating chamber, a selected service mode of the dispenser 103, room temperature, and the like. That is, the information screen 113 comprises set temperature information 113A of the freezing chamber and the refrigerating chamber, selected service mode information 113B of the dispenser 103 ('water mode' is selected in FIG. 2), date and time information 113C, and room temperature information 113D.

The standby screen can also be displayed on the display unit 110. As shown in FIG. 6, the standby screen where some pieces of the basic information displayed on the information screen 113, such as date and time information 113C, are relatively enlarged can be displayed on the display unit 110. The standby screen is displayed on the display unit 110 in case of an initial state, or if the input unit 120 receives an operation signal in a state where the main screen is displayed on the display unit 110, or an operation of the refrigerator such as opening/closing of a storage space through pivoting of the doors 101 and 101' by a user's manipulation is not performed for a predetermined period of time. In the present embodiment, a piece of the basic information displayed on the information screen 113 is determined to be displayed on the standby screen. However, it will be apparent that additional standby screen data may be stored in the storage unit 130 and a standby screen image of the standby screen data may be displayed on the display unit 110. Furthermore, the standby screen image of the standby screen data and any one piece of the basic information displayed on the information screen 113 may be displayed in an overlapping manner. If an operation of the refrigerator is performed by a user's manipulation in a state where the standby screen is displayed, the standby screen is displayed on the display unit 110.

In addition, a user interface displayed on the display unit 110 is to request another service, such as displaying cooking information or information on foods currently stored in the storage space of the refrigerator. Such a user interface may be displayed on the background screen 111.

The input unit 120 is provided at a side of the front surface of the door 101 in the vicinity of the display unit 110. The input unit 120 functions to receive operation signals for controlling general operations of the refrigerator and an operation signal for selecting an avatar, and to transmit a corresponding command to the microcomputer 140. The input unit 120 can receive the operation signals in a button type, a touchpad type, or an electro static type.

The input unit 120 comprises a temperature setting button 121 for setting the temperatures of the freezing chamber and the refrigerating chamber, a dispenser mode setting button 122 for setting a service mode (cubed ice, water, crushed ice, or the like) of the dispenser 103, a menu setting button 123 for activating and selecting the user interface displayed on the display unit 110, and a plurality of buttons 124, 125, 126 and 127 for selecting other functions. Here, the buttons 124, 125, 126 and 127 for selecting other functions may include, for example, a microphone activation setting button 124, a refrigerator chamber illuminating lamp activation setting button 125, an input unit lock/unlock setting button 126, an express freezing setting button 127, and the like. In addition, the input unit 120 may receive an operation signal for changing the background image of the background screen 111 or the avatar displayed on the display unit 110.

Meanwhile, the storage unit 130 stores the user interface for controlling general operations of the refrigerator, screen information, mode image data, and the like. As described above, the screen information includes main screen data containing background data for the background screen 111 and information data for the information screen 113; and standby screen data for the standby screen.

The background data for the background screen 111 include a plurality of background images and avatars. Scenery such as an iceberg or a mountain may be used as a background image of the background data for the background screen 111. An image of an animal such as a bear or a penguin may be used as an avatar of the background data for the background screen 111. The background data for the background screen 111 can be selected according to an operation signal received by the input unit 120.

The information data for the information screen 113 include set temperature information of the refrigerating chamber and the freezing chamber, service mode information of the dispenser, date and time information, and room temperature information. Here, the set temperature information of the refrigerating chamber and the freezing chamber means set temperatures of the refrigerating chamber and the freezing chamber. The service mode information of the dispenser means the water mode, the crushed ice mode, or the cubed ice mode that is set for the dispenser 103. In addition, the date and time information means information on date, day, time and the like, and the room temperature information means room temperature received from an additional temperature sensor (not shown).

In addition, the mode image data include mode images corresponding to the operations of the refrigerator and the service modes of the dispenser 103. For example, the mode image data may include mode images of the shape of an animal that feels cold or hot depending on a case where internal temperature of the freezing chamber and/or the refrigerating chamber of the refrigerator is below or above a set temperature, and mode images of the shape of water, crushed ice, or cubed ice corresponding to the 'water mode', the 'crushed ice mode', and the 'cubed ice mode' which are service modes of the dispenser 103. Such mode images may be represented as still images, moving images, animation, letters, figures, or like. Since the mode images are displayed on the background screen 111, they are preferably high definition data.

The microcomputer 140 reads screen information, i.e., main screen data including background data and information data, and standby screen data, stored in the storage unit 130, reads a background image (or an avatar) which is set as a default or selected according to an operation signal received by the input unit 120, and basic information, and displays the background image (or the avatar) and the basic information or standby screen data on the display unit 110 as the main screen or the standby screen. In addition, the microcomputer 140 reads the set service mode information of the dispenser and controls the dispenser 103 to provide services according thereto.

If the input unit 120, more specifically, the dispenser mode setting button 122, receives an operation signal for selecting the services of the dispenser 103, the microcomputer 140 performs control such that the service modes of the dispenser including the 'water mode', the 'crushed ice mode', and the 'cubed ice mode' can be sequentially selected. For example, if the dispenser mode setting button 122 initially receives a first operation signal once in a case where the set service mode of the dispenser 103 has been the 'water mode', the service mode of the dispenser 103 is set to the 'crushed ice mode'. Then, if the dispenser mode setting button 122 receives an operation signal once again, the service mode of the dispenser 103 is set to the 'cubed ice mode'. At this time, the sequence of circulation of the service modes according to the number of operation signals received by the dispenser mode setting button 122 may be made in any combination. That is, in the present embodiment, the service modes circulate in sequence of 'water mode'→'crushed ice mode'→'cubed ice mode'→'water mode' according to the number of operation signals received by the dispenser mode setting button 122. However, for example, the service modes may circulate in sequence of 'water mode'→'cubed ice mode'→'crushed ice mode'. Here, the microcomputer 140 performs control such that all other service modes other than the set service mode of the dispenser 103 can be set.

In addition, the microcomputer 140 reads the service mode of the dispenser 103 circulating according to an operation signal received by the input unit 120, reads corresponding mode image information stored in the storage unit 130, and displays the mode image information on the display unit 110. That is, in the process in which the input unit 120 receives an operation signal and the service mode of the dispenser 103 circulates, the microcomputer 140 performs control such that a mode image corresponding to each service mode can be displayed on the display unit 110.

Then, in a state where a mode image corresponding to the service mode of the dispenser 103 is displayed on the display unit 110, if the input unit 120 does not receive an operation signal for selecting the service mode or an operation signal for shifting to another service mode within a predetermined period of time, the microcomputer 140 performs control such that the service mode of the dispenser 103 can be set to the service mode corresponding to the mode image displayed on the display unit 110. In addition, if the input unit 120 receives an operation signal for selecting the service mode of the dispenser 103 corresponding to the mode image displayed on the display unit 110, the microcomputer 140 performs control such that the selected service mode of the dispenser 103 can be re-set (updated) to the current service mode and the selected service mode can be stored in the storage unit 130 as the current service mode. Such a process of re-setting (updating) the service mode of the dispenser 103 can be performed as soon as the input unit 120 receives an operation signal or after a predetermined period of time is elapsed. Meanwhile, if the selected service mode of the dispenser 103 is re-set (updated), the microcomputer 140 stops displaying a mode image corresponding to the service mode of the dispenser 103 on the display unit 110. In addition, the microcomputer 140 performs control such that the service mode of the dispenser 103 displayed in the area of the service mode information 113B of the dispenser can also be shown as the re-set service mode.

Of course, in a state where a mode image corresponding to the service mode of the dispenser 103 is displayed on the display unit 110, only when the input unit 120 receives an operation signal for selecting the service mode within a predetermined period of time, the microcomputer 140 can perform control such that the service mode of the dispenser 103 can be set to the service mode corresponding to the mode image displayed on the display unit 110. In a state where a mode image corresponding to the service mode of the dispenser 103 is displayed on the display unit 110, if the input unit 120 does not receive an operation signal for selecting the service mode or an operation signal for shifting to another service mode within a predetermined period of time, the microcomputer 140 performs control such that the main screen described above can be displayed on the display unit 110.

The microcomputer 140 performs control such that the dispenser 103 can operate according to the set service mode. That is, the microcomputer 140 performs control such that any one of water, crushed ice, and cubed ice can be dispensed through the dispenser 103 that is set to any one service mode of the 'water mode', the 'crushed ice mode, and the 'cubed ice mode'.

FIGS. 3 to 5 are front views schematically showing mode images corresponding to service modes of the dispenser, which are displayed according to a preferred embodiment of the present invention.

As shown in FIG. 3, a mode image corresponding to the 'water mode' of the service modes of the dispenser 103 is an animation in which an avatar of a bear image is pumping water. As shown in FIG. 4, a mode image corresponding to the 'crushed ice' of the service modes of the dispenser 103 is an animation in which an avatar of a bear image is carving ice. As shown in FIG. 3*c*, a mode image corresponding to the 'cubed ice' of the service modes of the dispenser 103 is an animation in which an avatar of a bear image is holding a container filled with cubed ice.

It will be apparent that mode images corresponding to the service modes of the dispenser 103 are not limited to animations described above but may be still images, moving images, or the like. In addition, although the avatar is shown as an image of a bear in this embodiment, it will be apparent that an avatar of any other image may also be employed. For example, a mode image corresponding to one of the service modes of the dispenser 103 may be represented as an animation in which an avatar of a water drop that is personified in the shape of a human operates a pump or carries crushed ice or cubed ice according to the service mode of the dispenser 103.

MODE FOR INVENTION

FIG. 7 is a view schematically showing the configuration of a control unit for a refrigerator according to a second embodiment of the present invention, and FIG. 8 is a front view showing a refrigerator provided with the control unit according to the second embodiment of the present invention.

As shown in the figures, the control unit for a refrigerator comprises a display unit 210 for displaying a variety of information and screens, an input unit 220 for receiving a variety of information for operations of the refrigerator, a storage unit 230 for storing a variety of information to be displayed on the display unit 210, an information receiving unit 240 for receiving weather information that is to be displayed on the display unit 210 or stored in the storage unit 230 from the outside, and a microcomputer 250 for controlling the display unit 210, the input unit 220, the storage unit 230 and the information receiving unit 240.

As shown in FIG. 5, the display unit 210 is placed in the vicinity of a dispenser 203 provided on a front surface of a door 201 of a pair of doors 201 and 201' that selectively open and close a freezing chamber and a refrigerating chamber provided inside a main body 20 of the refrigerator. The display unit 210 externally displays a main screen and setting screens stored in the storage unit 230. The main screen externally displayed through the display unit 210 includes a background screen 211 and first and second information screens 212 and 213. The background screen 211 contains an avatar and a background image, and the first information screen 212 contains a set temperature of a storage space of the refrigerator and a set service mode of the dispenser. The second information screen 213 contains weather information and date and time information received by the information receiving unit 240. The setting screens include a menu setting screen and a detail setting screen inputted into the input unit 220, and an independent function screen. The setting screens will be described in detail when the input unit 220 and the storage unit 230 are described.

The input unit 220 is placed closely on both sides of the display unit 210. The display unit 210 is constructed in a button type, a touchpad type, or an electrostatic type, and receives operation signals for setting operations of the refrigerator including the dispenser 203, for setting the main screen displayed on the display unit 210, and the like.

That is, in FIG. 5, a temperature setting button 221, a dispenser mode setting button 222, and a menu setting button 223 are provided on the left side of the display unit 210. The temperature setting button 221 is to set the temperatures of the freezing chamber and the refrigerating chamber, and the dispenser mode setting button 222 is to set the service mode of the dispenser. In addition, the menu setting button 223 receives an operation signal for activating the menu setting screen on the display unit 210.

In FIG. 5, a plurality of detail setting buttons 224, 225, 226 and 227 are provided on the right side of the display unit 210. The detail setting buttons 224, 225, 226 and 227 include an up and down buttons 224 and 225 for receiving operation signals for sequentially highlighting information or a menu so as to set the information or the menu displayed on the display unit 210, a left and right buttons 226 and 227 for receiving operation signals for increasing and decreasing the value of a menu so as to specifically set the menu displayed on the display unit 210, and a select/confirm button 228 for receiving an operation signal for selecting the information or the menu highlighted by the up and down buttons 224 and 225 or storing the value of the menu increased or decreased by the left and right buttons 226 and 227. The up and down buttons 224 and 225, and the left and right buttons 226 and 227 are preferably provided to be located on the up, down, left, and right sides of the select/confirm button 228.

Meanwhile, the up, down, left and right buttons 224, 225, 226 and 227 respectively receive operation signals for selecting independent functions in addition to the operation signals for specifically setting menus displayed on the display unit 210. That is, the up button 224 receives an operation signal for displaying weather information on the display unit 210, and the down button 225 receives an operation signal for turning on/off an illumination lamp of the dispenser 203. The left and right buttons 226 and 227 respectively receive operation signals for setting locking/unlocking of the input unit 220 and an operation signal for setting an opening alarm for the doors 201 and 201'.

The independent functions of the up, down, left and right buttons 224, 225, 226 and 227 will be described in greater detail blow. If the up button 224 receives an operation signal, weather information stored in the storage unit 230 is displayed on the display unit 210. If the down button 225 receives an operation signal, an independent function screen for displaying the current on/off setting state of the illumination lamp of the dispenser 203 is displayed on the display unit 210. In this state, if the down button 225 receives an operation signal once more, the current on/off setting state of the illumination lamp of the dispenser 203 is changed. Meanwhile, if the left button 226 receives an operation signal, an independent function screen for displaying the current locking/unlocking setting state of the input unit 220 is displayed on the display unit 210. If the left button 226 receives an operation signal once more, the current locking/unlocking setting state of the input unit 220 is changed. In addition, if the right button 227 receives an operation signal, an independent function screen for displaying the current opening alarm setting state of the doors 201 and 201' is displayed on the display unit 210. If the right button 227 receives an operation signal once more, the current opening alarm setting state of the doors 201 and 201' is changed.

Meanwhile, the storage unit 230 stores main screen information. The main screen information stored in the storage unit 230 includes background data for the background screen 211 and information data for the first and second information screens 212 and 213. The background data for the background screen 211 include a background image and an avatar. The information data for the first and second information screens 212 and 213 include set temperature information of the freezing chamber and the refrigerating chamber, service mode setting information of the dispenser 203, locking/unlocking setting information of the input unit, opening alarm setting information of the doors of the refrigerator, on/off setting information of the illumination lamp of the dispenser, date and time information, weather information, and the like.

Here, the weather information includes measured or observed information on current weather conditions and forecasted information on future weather. Factors for measuring or observing weather or forecasting weather include atmospheric pressure, temperature highest temperature, lowest temperature, and average temperature), wet bulb temperature, vapor pressure, dew point temperature, relative humidity, wind direction, wind speed, rainfall, clouds, evaporation, sunshine duration, solar radiation, rainfall frequency, and other phenomena.

In addition, the storage unit 230 stores setting screen information. The setting screen information includes menu setting screen information, detail setting screen information, and independent function screen information. If the menu setting button 223 receives an operation signal, the menu setting screen information is displayed on the display unit 210 and includes certain information or menu items, and a highlighting portion for selecting information or a menu. If the up and down buttons 224 and 225 receive operation signals in a state where the menu setting screen information is displayed on the display unit 210, the highlighting portion is sequentially moved to overlap with the information or menu. The detail setting screen information includes subordinate contents of the menu setting screen, and the independent function screen information relates to independent functions of the up, down, left and right buttons 224, 225, 226 and 227, which have no relation to the menu setting screen.

Further, the storage unit 230 can store a variety of information, such as a refrigerator electronic manual for guiding usage of the refrigerator. The refrigerator electronic manual stored in the storage unit 230 as such is displayed on the display unit 210 according to an operation signal received by the input unit 220.

The information receiving unit 240 receives data from a weather information providing server through wired or wireless communications, extracts weather information from the received data, and transmits the weather information to the microcomputer 250. For example, the information receiving unit 240 is a wireless receiving module for receiving wireless signals of the server, which are transmitted through a communication port connected to a wired communication network such as the Internet or through a wireless communication network. The information receiving unit 240 may be embedded in or externally connected to the refrigerator. The weather information extracted by the information receiving unit 240 is transmitted to the microcomputer 250 through wired or wireless communications.

The microcomputer 250 reads main screen information stored in the storage unit 230, reads a background image (or an avatar), which is set as a default or selected according to an operation signal received by the input unit 220, and basic information, and displays the background image (or the avatar) and the basic information on the display unit 210 as the main screen. In addition, the microcomputer 250 performs control such that the weather information received and extracted by the information receiving unit 240 can be received and stored into the storage unit 230, and at the same time, such that the weather information can be read and displayed on the display unit 210. That is, the microcomputer 250 performs control such that a variety of information including background images and weather information can be displayed on the display unit 210.

In addition, if the input unit 220 does not receive an input signal within a predetermined period of time during a menu setting process, a detail setting process or an independent function process, the microcomputer 250 performs control such that the main screen can be displayed on the display unit 210. For example, in a state where the menu setting button 223 receives an operation signal and the menu setting screen is displayed on the display unit 210, if the detail setting buttons 224, 225, 226 and 227 do not receive an operation signal within a predetermined period of time, the microcomputer 250 performs control such that the main screen can be displayed on the display unit 210.

Next, the menu setting process and the detail setting process in the second embodiment of the present invention will be described in greater detail with reference to the accompanying drawings.

FIG. 9 is a flowchart illustrating the menu setting and detail setting processes in the second embodiment of the present invention.

As shown in the figure, the main screen including the background screen 211 and the first and second information screens 212 and 213 is displayed on the display unit 210 in an initial state (S11). In this state, the microcomputer 250 determines whether the menu setting button 223 receives an operation signal, i.e., whether a user manipulates the menu setting button 223 (S12). Then, if it is determined that the menu setting button 223 is manipulated in step S12, the microcomputer 250 performs control such that the menu setting screen stored in the storage unit 230 is displayed on the display unit 210 (S13). At this time, the microcomputer 250 performs control such that the highlighting portion is displayed to overlap with a specific menu in the menu setting screen.

In this state, the microcomputer 250 determines whether the detail setting buttons 224, 225, 226 and 227 are manipulated to select a menu in the menu setting screen within a predetermined period of time (S14). At this time, the user manipulates the up and down buttons 224 and 225 of the detail setting buttons 224, 225, 226 and 227 to move the position of the highlighting portion to the menu desired to be set. Then, the microcomputer 250 determines whether the menu is selected through manipulation of the select/confirm button 228 within a predetermined period of time (S15). That is, in a state where the highlighting portion is placed on a certain menu, the user manipulates the select/confirm button 228 to select the menu desired to be set.

If the detail setting buttons 224, 225, 226 and 227 and the select/confirm button 228 are determined to have been manipulated within a predetermined period of time, the microcomputer 250 performs control such that the detail setting screen for the selected menu can be displayed on the display unit 210 (S16). Then, the microcomputer 250 determines whether the up and down buttons 224 and 225 for selecting a menu and the left and right buttons 226 and 227 for adjusting the set value of the menu among the detail setting buttons 224, 225, 226 and 227 are manipulated within a predetermined period of time (S17).

Next, after the detail setting for the menu is completed through manipulation of the detail setting buttons 224, 225, 226 and 227, the microcomputer 250 determines whether the completed detail setting is confirmed through manipulation of the select/confirm button 228 within a predetermined period of time (S18). If the detail setting for the menu is confirmed through manipulation of the select/confirm button 228 in step S18, the microcomputer 250 performs control such that the detailed setting can be stored into the storage unit 230 and the main screen updated with the set value of the menu can be displayed on the display unit 210 (S19).

Meanwhile, if the menu setting button 223 is not manipulated in step S12, the microcomputer 250 determines whether the detail setting buttons 224, 225, 226 and 227 are manipulated (S20). If the menu setting button 223 is manipulated in step S20, the microcomputer 250 performs control such that an independent function screen can be displayed on the display unit 210 (S21).

In a state where the independent function screen is displayed on the display unit 210, the microcomputer 250 determines whether an independent function is set through manipulation of the detail setting buttons 224, 225, 226 and 227 within a predetermined period of time (S22). In a state where the independent function is set through manipulation of the detail setting buttons 224, 225, 226 and 227 in step S22, the microcomputer 250 determines whether the set independent function is confirmed through manipulation of the select/confirm button 228 within a predetermined period of time (S23). If it is determined that the independent function is confirmed, the setting of the independent function is stored in the storage unit 230 (S24).

In addition, in steps S14, S15, S17, S18, S20, S22 and S23, if the detail setting buttons 224, 225, 226 and 227 or the select/confirm button 228 is not manipulated within a predetermined period of time, the microcomputer 250 performs control such that the main screen can be displayed on the display unit 210. That is, in the process of setting a menu and details thereof, if the process is stopped before completion thereof, the main screen is displayed on the display unit 210.

Next, the temperature setting screen, the menu setting screen, and the independent function screen displayed on the display unit in the second embodiment of the present invention will be described in greater detail with reference to the accompanying drawings.

FIG. 10 is a front view schematically showing the temperature setting screen displayed on the display unit in the second embodiment of the present invention.

As described in the figure, if the temperature setting button 211 receives an operation signal, the micro computer 250 causes the temperature setting screen 214 to be displayed on the display unit 210. A refrigerating chamber temperature setting menu 215A, a freezing chamber temperature setting menu 216A, and an express freezing chamber temperature setting menu 217A are displayed on the temperature setting screen 214. At this time, the highlighting portion is preferably displayed to overlap with the refrigerating chamber temperature setting menu 215A that is placed at the relatively uppermost position in the temperature setting screen 214. The refrigerating chamber temperature setting menu 215A, the freezing chamber temperature setting menu 216A, and the express freezing chamber temperature setting menu 217A have set temperature display portions 215B, 216B and 217B for displaying current set temperatures, cooling power display portions 215C, 216C and 217C for displaying cooling power according thereto, and temperature variation display portions 215D, 215E, 216D, 216E, 217D and 217E for displaying increases or decreases in the set temperatures, respectively.

The temperature setting screen 214 shown in FIG. 8 is a menu setting screen for setting the temperatures of the refrigerating chamber and the freezing chamber, in which a detail setting screen of the temperature setting screen is not used. Accordingly, if a detail setting screen is used for the temperature setting screen 214, the set temperature display portions 215B, 216B and 217B, the cooling power display portions 215C, 216C and 217C, and the temperature variation display portions 215D, 215E, 216D, 216E, 217D and 217E will be displayed on the detail setting screen of the temperature setting screen 914.

FIG. 11 is a front view schematically showing a menu setting screen displayed on the display unit in the second embodiment of the present invention, and FIG. 12 is a front view schematically showing a detail setting screen for the menu setting screen shown in FIG. 11.

As shown in FIG. 11, if the menu setting button 223 receives an operation signal, the microcomputer 250 performs control such that menu setting screen information stored in the storage unit 230 is read and a menu setting screen 314 is displayed on the display unit 210. At this time, the highlighting portion 315 is placed to overlap with any one of menus displayed on the menu setting screen 314. Then, if the up and down buttons 224 and 225 among the detail setting buttons 224, 225, 226 and 227 receive an operation signal, the microcomputer 250 performs control such that the position of the highlighting portion 315 is moved up and down to select another menu displayed on the menu setting screen 314.

'Weather forecasting information', i.e., the first menu, of the menu setting screen 314 is to cause weather information received through the information receiving unit 240 to be displayed on the display unit 210. That is, if the select/confirm button 228 receives an operation signal in a state where the highlighting portion 315 is placed on the 'weather forecasting information' menu, the microcomputer 250 performs control such that weather information stored in the storage unit 230 is read and the weather information is displayed on the display unit 210.

'Refrigerator electronic manual', i.e., the second menu, of the menu setting screen 314 is to cause usage of the refrigerator to be displayed on the display unit 210. Accordingly, if the select/confirm button 228 receives an operation signal in a state where the highlighting portion 315 is placed on the 'refrigerator electronic manual' menu, the microcomputer 250 performs control such that information stored in the storage unit 230 is displayed on the display unit 210.

Meanwhile, 'power saving function', i.e., the third menu, of the menu setting screen 314 is to set an LCD window of the display unit 210 so as to be automatically turned off after a predetermined period of time is elapsed. 'Background (clock) setting', i.e., the fourth menu, of the menu setting screen 314 is to set a background, time, or the like displayed as the main screen on the display unit 210. If the select/confirm button 228 receives an operation signal in a state where the highlighting portion 315 is placed on the 'power saving function' menu or the 'background (clock) setting', the microcomputer 250 performs control such that respective detail setting menu information is read from the storage unit 230 and a detail setting menu 316 is displayed on the display unit 210.

As shown in FIG. 10 (→12), a detail setting menu for setting an off time of the LCD window, i.e., a time period required for automatically turning off the LCD window, which is elapsed without manipulation of the refrigerator (such as, opening/closing of the doors 201 and 201' of the refrigerator) by a user or without input of an operation signal into the input unit 220, is displayed in the detail setting menu 316 of the 'power saving function' menu of the menu setting screen 314. That is, an LCD window off time display portion 317A and increase/decrease buttons 317B for increasing and decreasing the off time of the LCD window are displayed in the detail setting menu 316.

FIG. 13 is a front view schematically showing an independent function screen displayed on the display unit in the second embodiment of the present invention.

As shown in the figure, if the down button 225 among the detail setting buttons 224, 225, 226 and 227 receives an operation signal in a state where the temperature setting button 221, the dispenser 203, and the menu setting button 223 are not manipulated, a dispenser illumination lamp on/off setting screen 414 is displayed on the display unit 210. That is, if the down button 225 receives an operation signal in a state where the main screen is displayed on the display unit 210, the dispenser illumination lamp on/off setting screen 414 is displayed on the display unit 210 as currently set. If the down button 225 receives an operation signal in this state, the illumination lamp on/off setting of the dispenser is changed.

Next, a control unit for a refrigerator according to a third embodiment of the present invention will be described in greater detail with reference to the accompanying drawings.

FIG. 14 is a front view schematically showing a control unit for a refrigerator according to a third embodiment of the present invention.

As shown in the figure, the basic configuration of this embodiment is same as that of the second embodiment. That is, the control unit for a refrigerator according to this embodiment also comprises a display unit 510 for displaying a main screen and a setting screen 515, and an input unit 520 for receiving operation signals for operations of the refrigerator.

In this embodiment, function display bars 517 and 519 are displayed on both sides of the setting screen 515 displayed on the display unit 510. The input unit 520 comprises three menu setting buttons 521, 522 and 523 and three detail setting buttons 524, 525 and 526, which are provided vertically at regular intervals on both sides of the display unit 510. Here, as shown in FIG. 14, the menu setting buttons 521, 522 and 523 are provided on the left side of the display unit 510, and the detail setting buttons 524, 525 and 526 are provided on the right side of the display unit 510.

The function display bars 517 and 519 serve to display the functions of the menu setting buttons 521, 522 and 523 and the detail setting buttons 524, 525 and 526 in accordance with the setting screen 515, i.e., the menu setting screen, the detail setting screen or the like, displayed on the display unit 510. For example, the menu setting button 521 at a relatively upper position and the menu setting button 523 at a relatively lower position respectively receive operation signals for returning to the main screen and to an upper menu screen from the setting screen 515 displayed on the display unit 510, and the left side function display bar 517 of FIG. 14 corresponding thereto displays functions 517A and 517B of the menu setting buttons 521 and 523. The detail setting buttons 524, 525 and 526 receive operation signals for vertically moving the highlighting portion in the setting screen 515 displayed on the display unit 510 or for selecting/confirming a menu where the highlighting portion is placed, and the right side function display bar 519 of FIG. 14 corresponding thereto displays functions 519A, 519B and 519C of the detail setting buttons 524, 525 and 526.

Next, a control unit for a refrigerator according to a fourth embodiment of the present invention will be described in further detail with reference to the accompanying drawings.

FIG. 15 is a front view showing a refrigerator provided with the control unit for a refrigerator according to the fourth embodiment of the present invention, FIGS. 16 to 18 are views schematically showing a process of displaying menus on a display unit in the fourth embodiment of the present invention.

As shown in the figure, the refrigerator is provided with a pair of doors 601 and 601' for selectively opening and closing a storage space, i.e., a freezing chamber and a refrigerating chamber, provided inside a main body 600 of the refrigerator. Any one door 601 of the doors 601 and 601' is provided with a dispenser 603. The dispenser 603 is to dispense water or ice to the outside without opening the door 601.

The dispenser 603 is provided with a display unit 610 and an input unit 620. The display unit 610 is to display a variety of menus for operating the refrigerator. The input unit 620 is to select any one of the menus displayed on the display unit 610 and to receive operation signals for operating the refrigerator.

As specifically shown in FIG. 16, an upper menu M and a corresponding avatar A are displayed on the display unit 610. The upper menu M comprises a plurality of menus, i.e., menu 1 M1 and menu 2 M2. The avatar A is to allow a user to easily identify the upper menu M and to express the upper menu M more familiarly. The avatar A may be represented as an image of a human or animal and also shown as a different image according to the upper menu M.

The input unit 620 is provided with a plurality of buttons 612. In this embodiment, the input unit 620 is provided with six buttons 612 of which three is vertically arranged at each of both sides of the display unit 610.

Meanwhile, if the button 621 receives an operation signal for selecting any one of the upper menu M, e.g., menu 1 M1, as shown in FIG. 17, a description on the menu 1 M1 is displayed on the display unit 610 together with the avatar A. In addition, a lower menu m, i.e., menu A m1 and menu B m2, subordinate to the menu 1 M1 is also simultaneously displayed on the display unit 610. The description and the avatar A of the menu 1 M1, and the lower menu m are preferably displayed in a portion that is divided from the portion where the upper menu M is displayed.

In a state where the menu 1 M1 is selected, and the description and the avatar A of the menu 1 M1, and the lower menu m subordinate thereto are displayed on the display unit 610 as described above, if the button 621 receives an operation signal for selecting any one of the lower menu m, as shown in FIG. 18, a description and an avatar A of the selected any one of the lower menu m, and a secondary lower menu m' subordinate to the selected any one of the lower menu m are displayed on the display unit 610. That is, if the button 621 receives an operation signal for selecting the menu B m2, a description and an avatar A of the menu B m2, and menu a m'1 and menu b m'2 that are the secondary lower menu m' subordinate thereto are displayed on the display unit 610.

The image of the avatar A may be changed according to the upper menu M, the lower menu m, and the secondary lower menu m'. In addition, the descriptions and the avatars A of the menus M, m, and m' are stored in an additional storage unit (not shown). Meanwhile, if a tertiary lower menu subordinate to the secondary lower menu m' exists, the aforementioned process will be repeatedly performed. If a lowest menu is selected by an operation signal inputted through the button 621, a controller (not shown) controls the operation of the refrigerator according to the lowest menu.

Hereinafter, the process of displaying menus on the display unit in the fourth embodiment of the present invention will be described in greater detail with reference to the accompanying drawings.

FIG. 19 is a flowchart illustrating the process of displaying menus on the display unit in the fourth embodiment of the present invention.

As shown in the figure, the description and the avatar of the upper menu M are displayed on the display unit 610 (S21). The upper menu M may be initially displayed on the display unit 610. Alternatively, the upper menu M may be displayed on the display unit 610 according to an operation signal inputted through the input unit 620 in a state where a separate main screen is displayed, or the upper menu M may be displayed on the display unit 610 according to a distance between a user and the display unit 610.

In this state, the user inputs an operation signal for selecting any one of the upper menu M through the button 621 of the input unit 620 (S22). With the selection of any one of the upper menu M, a description and an avatar A of the selected any one of the upper menu M, and the lower menu m subordinate thereto are displayed on the display unit 610 (S23 and S24). At this time, displaying the description and the avatar A of the selected any one of the upper menu M and displaying the lower menu m subordinate thereto may be performed at a certain time interval. In addition, the user can move to step S21 by inputting an operation signal through the button 621.

Next, the user inputs an operation signal for selecting any one of the lower menu m through the button 621 (S25). At this time, if any one of the lower menu m selected in step S25 is a lowest menu, the refrigerator operates under the control of the controller according to the selected any one of the lower menu m (S26 and S27). If any one of the lower menu m selected in step S25 is not a lowest menu, a description and an avatar A of the selected any one of the lower menu m, and a secondary lower menu m' subordinate thereto are displayed on the display unit 610 (S26, S28 and S29).

Depending on whether the secondary lower menu m' displayed in step S29 is a lowest menu, any one of the secondary lower menu m' is selected and the refrigerator operates according thereto, or a tertiary lower menu subordinate to the secondary lower menu m' is displayed and selected under the control of the controller.

The scope of the present invention is not limited to the aforementioned embodiments but defined by the appended claims, and it will be readily understood by those skilled in the art that various adaptations and changes can be made thereto within the spirit and scope of the present invention defined by the appended claims.

INDUSTRIAL APPLICABILITY

With the control unit for a refrigerator and a method of controlling the same according to the present invention, it can be expected to obtain the following effects.

First, according to the present invention, menus of more various functions can be displayed in the form of images or the like. Accordingly, a user can more easily identify and set the menus.

Furthermore, since a variety of menus can be selected according to the sequence of manipulating buttons in the present invention, the menus can be selected only with the limited number of buttons. Accordingly, the configuration of the input unit can be simplified and the area of the display unit can be maximized within a limited space.

According to the present invention, if a user inputs an operation signal, upper manus and lower menus are sequentially displayed. Accordingly, the user can more easily recognize the menus and thus further conveniently manipulate the control unit.

The invention claimed is:

1. A control unit for a refrigerator, comprising:

an input means having a temperature setting button for receiving an operation signal for selecting a temperature setting menu for a storage space of the refrigerator, and a detail setting button for receiving an operation signal for setting a temperature of the storage space or setting an independent function; and a control means for performing control such that the setting of the temperature of the storage space or the setting of the independent function is carried out according to a sequence of manipulating the temperature setting button and the detail setting button, wherein the detail button includes:

a pair of buttons for sequentially highlighting a menu in order to select any one of a refrigerating chamber temperature setting menu, a freezing chamber temperature setting menu, and an express freezing chamber temperature setting menu displayed on the display means;

a pair of buttons for increasing or decreasing any one of a set temperature of the refrigerating chamber, a set temperature of the freezing chamber, and a set temperature of the express freezing chamber displayed on the display means; and a button for selecting any one of the refrigerating chamber temperature setting menu, the freezing chamber temperature setting menu, and the express freezing chamber temperature setting menu, or for confirming an increase or decrease in any one of the refrigerating chamber set temperature, the freezing chamber set temperature, and the express freezing chamber set temperature.

2. The control unit as claimed in claim 1, wherein the control means performs control such that the temperature setting for the storage space is carried out if the temperature setting button is manipulated prior to manipulation of the detail setting button, and the independent function setting is carried out if the detail setting button is manipulated prior to manipulation of the temperature setting button.

3. A control unit for a refrigerator, comprising:

an input means having a temperature setting button for receiving an operation signal for selecting a temperature setting menu for a storage space of the refrigerator, and a detail setting button for receiving an operation signal for setting a temperature of the storage space or setting an independent function;

a storage means for storing a temperature setting screen for setting a temperature of the storage space and an independent function setting screen for setting an independent function;

a display means for displaying the temperature setting screen and the independent function setting screen; and a control means for performing control such that the temperature setting screen or the independent function setting screen is displayed on the display means according to a sequence of manipulating the temperature setting button and the detail setting button, wherein the storage spaces includes at least one of a refrigerating chamber, a freezing chamber, and an express freezing chamber, and the temperature setting menu includes at least one of a refrigerating chamber temperature setting menu, a freezing chamber temperature setting menu and an express freezing chamber temperature setting menu, and wherein the detail button includes:

a pair of buttons for sequentially highlighting a menu in order to select any one of the refrigerating chamber temperature setting menu, the freezing chamber temperature setting menu, and the express freezing chamber temperature setting menu displayed on the display means;

a pair of buttons for increasing or decreasing any one of a set temperature of the refrigerating chamber, a set temperature of the freezing chamber, and a set temperature of the express freezing chamber displayed on the display means; and a button for selecting any one of the refrigerating chamber temperature setting menu, the freezing chamber temperature setting menu, and the express freezing chamber temperature setting menu, or for confirming an increase or decrease in any one of the refrigerating chamber set temperature, the freezing chamber set temperature, and the express freezing chamber set temperature.

4. The control unit as claimed in claim 3, wherein the control means performs control such that the temperature setting screen is displayed on the display means if the temperature setting button is manipulated prior to manipulation of the detail setting button, and the independent function setting screen is displayed on the display means if the detail setting button is manipulated prior to manipulation of the temperature setting button.

5. The control unit as claimed in claim 3, wherein the temperature setting screen and the independent function setting screen include function display bars for displaying the functions of the temperature setting button and the detail setting button for temperature setting or independent function setting, respectively, and the control means performs control such that if any one of the temperature setting screen and the independent function setting screen is displayed on the display means, the function display bar for temperature setting or independent function setting is displayed at one side of the display means in the vicinity of the temperature setting button or the detail setting button.

6. A control unit for a refrigerator, comprising:

an input means having a menu setting button for receiving an operation signal for selecting a menu of the refrigerator to be set, and a detail setting button for receiving an operation signal for detail setting of a selected menu or separate independent function setting; and a control means for performing control such that either the menu setting and detail setting thereof or the independent function setting is carried out according to a sequence of manipulating the menu setting button and the detail setting button, wherein the detail button includes:

a pair of buttons for sequentially highlighting a menu in order to select any one of a refrigerating chamber temperature setting menu, a freezing chamber temperature setting menu, and an express freezing chamber temperature setting menu displayed on the display means;

a pair of buttons for increasing or decreasing any one of a set temperature of the refrigerating chamber, a set temperature of the freezing chamber, and a set temperature of the express freezing chamber displayed on the display means; and a button for selecting any one of the refrigerating chamber temperature setting menu, the freezing chamber temperature setting menu, and the express freezing chamber temperature setting menu, or for confirming an increase or decrease in any one of the refrigerating chamber set temperature, the freezing chamber set temperature, and the express freezing chamber set temperature.

7. The control unit as claimed in claim 6, wherein the control means performs control such that the menu setting and detail setting thereof are carried out if the menu setting button is manipulated prior to manipulation of the detail setting button, and the independent function setting is carried out if the detail setting button is manipulated prior to manipulation of the menu setting button.

8. A control unit for a refrigerator, comprising:

an input means having a menu setting button for receiving an operation signal for menu setting or information display for the refrigerator and a detail setting button for receiving an operation signal for detail setting of a selected menu or separate independent function setting;

a storage means for storing a menu setting screen for the menu setting, a detail setting screen for the detail setting of the selected menu, and an independent function setting screen for the independent function setting;

a display means for displaying the menu setting screen, the detail setting screen, and the independent function setting screen; and a control means for performing control such that any one of sequential display of the menu setting screen and the detail setting screen, display of information, and display of the independent function setting screen is carried out on the display means according to a sequence of manipulating the menu setting button and the detail setting button, wherein the detail button includes:

a pair of buttons for sequentially highlighting a menu in order to select any one of a refrigerating chamber temperature setting menu, a freezing chamber temperature setting menu, and an express freezing chamber temperature setting menu displayed on the display means;

a pair of buttons for increasing or decreasing any one of a set temperature of the refrigerating chamber, a set temperature of the freezing chamber, and a set temperature of the express freezing chamber displayed on the display means; and a button for selecting any one of the refrigerating chamber temperature setting menu, the freezing chamber temperature setting menu, and the express freezing chamber temperature setting menu, or for confirming an increase or decrease in any one of the refrigerating chamber set temperature, the freezing chamber set temperature, and the express freezing chamber set temperature.

9. The control unit as claimed in claim 8, wherein the control means performs control such that the sequential display of the menu setting screen and the detail setting screen or the display of information is carried out on the display means if the menu setting button is manipulated prior to manipulation of the detail setting button, and the display of the independent function setting screen is carried out on the display means if the detail setting button is manipulated prior to manipulation of the menu setting button.

10. The control unit as claimed in claim 8, wherein the menu setting screen, the detail setting screen, and the independent function setting screen include function display bars for displaying functions of the menu setting button and detail setting button for the menu setting and detail setting and the independent function setting, respectively, and the control means performs control such that the function display bar for the menu setting and detail setting or the independent function setting is displayed at one side of the display means in the vicinity of the menu setting button and the detail setting button if any one of the temperature setting screen, the detail setting screen, and the independent function setting screen is displayed on the display means.

* * * * *